US005168116A

United States Patent [19]

Iizuka

[11] Patent Number: 5,168,116

[45] Date of Patent: Dec. 1, 1992

[54] METHOD AND DEVICE FOR COMPRESSING SIGNALS OF PLURAL CHANNELS

[75] Inventor: Akira Iizuka, Hamamatsu, Japan

[73] Assignee: Yamaha Corporation, Hamamatsu, Japan

[21] Appl. No.: 430,424

[22] Filed: Nov. 1, 1989

[30] Foreign Application Priority Data

Nov. 2, 1988 [JP] Japan ..... 63-278182
Nov. 8, 1988 [JP] Japan ..... 63-281638

[51] Int. Cl.[5] ..... G10H 1/06; G10H 7/02

[52] U.S. Cl. ..... 84/603; 84/622; 341/122; 341/143; 341/200; 364/715.02; 375/27

[58] Field of Search ..... 84/603, 607, 622-625; 375/27-33; 364/715.02; 332/109-111; 333/14; 358/13, 135; 341/122-125, 143, 200

[56] References Cited

U.S. PATENT DOCUMENTS 4,099,122 7/1978 van Buul ..... 375/30
4,754,258 6/1988 Nakamura et al. ..... 341/143 X
4,797,653 1/1989 Takayama ..... 375/27 X
4,905,562 3/1990 Beacham .
4,916,996 4/1990 Suzuki et al. ..... 84/603
4,992,889 2/1991 Yamagami et al. ..... 358/135 X

FOREIGN PATENT DOCUMENTS 59-166293 11/1984 Japan .

OTHER PUBLICATIONS

Vail, Mark, "Yamaha TX16W 12-Bit Sampler", Keyboard Report, Jun. 1988.

*Primary Examiner*—Stanley J. Witkowski
*Attorney, Agent, or Firm*—Spensley Horn Jubas & Lubitz

[57] ABSTRACT

When analog signals of two or more channels are converted to digital signals, a differential signal of at least two of these channels (A and B) is taken out. The signal of either channel A or B or the sum signal of these signals and the above-mentioned differential signal are quantized by binary-coding with n and m bits (n>m), respectively. The quantization is also performed by sampling with the sampling frequency f1 and f2 (f1>f2). As a result the memory capacity is saved and the transmission speed is improved.

28 Claims, 25 Drawing Sheets

METHOD AND DEVICE FOR COMPRESSING SIGNALS OF PLURAL CHANNELS

BACKGROUND OF THE INVENTION

1. Field of the Invention

This invention relates to a method for compressing the signals of several channels such as signals of L channel and R channel, to a compressed signal storing device, and to an electronic musical instrument using the device.

2. Description of the Prior Art

The technology to convert the signals of several channels such as stereo signals to the digital signals such as PCM data is especially applied for storing these signals in the memory. The memory in which the PCM data is stored can be used, for example, for the electronic musical instrument. Formerly, the memory in which the PCM data is stored is corresponding to each channel, and the data of each memory is read to perform individually DA conversion when signals of all channels are reproduced. For instance, several memories (i.e., Japanese utility model laid open sho 59-166293) which store the musical tone waveform data for each channel are provided as sound source, the musical tone data corresponding to the key pressed by the player is individually read from the memories, and these musical tone data are converted to the analog signals through the DA converter to get sound.

Since the memory is individually corresponded to each channel, this conventional system needs "memories×N" where N is the number of channels. Moreover, the time required to digitize and transmit the signal is equal to "transmission time for one channel×N" where N is the number of channels.

SUMMARY OF THE INVENTION

In brief, my invention contemplates a sampling by taking out the differential signal of the signals of at least two of several channels, namely signals of channel A and Channel B (when converting each signal of several channels to the digital signal), and then sampling the signal of either channel A or channel B or the sum signal of them and above-mentioned differential signal with frequency f1 and f2 (f1>f2), respectively.

This invention contemplates a quantization by taking out the differential signal of signals of at least two of several channels namely signals of chanel A and channel B (when converting each signal of several channels to the digital signals), and then quantizing the signal of either channel A or channel B or the sum signal of them and the above-mentioned differential signal with n bits and m bits (n>m), respectively.

This invention contemplates provision of a memory to store each compressed data quantized by the above-mentioned method.

It is an object of the invention to provide a signal compressing method for signals of several channels which makes it possible to solve the above-mentioned problems by taking out the differential signal of signals of several channels and to provide a compressed signal storing device for storing the thereby compressed signals.

The signal compressing method of this invention features that a differential signal (A−B) of signals of at least two of several channels, namely channels A and B, is taken out, the signal of either channel A or B or sum signal thereof (A+B) and the above-mentioned differential signal (A−B) are quantized with n bits and m bits, respectively. As is well known, if the differential signal (A−B) is taken out, the initial signal can be easily restored by combining the signal of either initial channel A or B or the sum signal thereof (A+B), namely by adding or subtracting these signals in the reproduction mode.

When the signals of several channels are reproduced, in most cases, the amplitude of the differential signal is smaller than the amplitude of signal of each channel. Especially, this trend appears remarkably in the case when the signals of several channels are stereo signals of channels L and R. Accordingly, even when the differential signal is quantized with bits, the number of which is smaller than the number of bits of initial signal, the sound quality and S/N ratio are not affected in the reproduction mode. Consequently, when the signal of one of several channels, namely either channel A or B, is quantized with n bits and the differential signal of signals of channels A and B is quantized with m bits (n>m), the information necessary to reproduce the signals of channels A and B is less than the information which is based on individual quantization of the signals of channels A and B. Similarily, the information which is based on quantization of the sum signal of signal of channels A and B with n bits and quantization of the above-mentioned differential signal with m bits is less than the information based on individual quantization of the signal of channels A and B. Therefore, when the initial signal is converted to the digital signal and then the digital signal is stored in the memory, the required memory capacity is less than the memory capacity required for individual storage of signal of each channel. Moreover, the signal transmission time is shorter than the transmission time required to transmit individually the signal of each channel.

Another signal compressing method of this invention features that the differential signal (A−B) of signals at least two of several channels, namely channels A and B, is taken out, and the signal of either channel A or B or the sum signal thereof (A+B) and the above-mentioned differential signal (A−B) are sampled at sampling frequency f1 and f2 (F1>f2), respectively. As is well known, if the differential signal (A−B) is taken out, the initial signal can be easily restored by combining the signal of either initial channel A or B or the sum signal thereof (A+B), namely by adding or subtracting these signals in the reproduction mode.

When the signals of several channels are reproduced, in most cases the frequency band of differential signal can be narrower than the frequency band of signal of each channel.

For example, when the signal of several channels is the stereo signal of L channel and R channel, the stereo feeling created by the difference in high range (audition) between left side and right side is weak as a whole. Accordingly, even when the differential signal of both channels is sampled at frequency lower than the initial signal sampling frequency, the sound quality is less affected in the reproduction mode. Hence, the signal of one of several channels, namely channel A or B, is sampled at the sampling frequency f1, the differential signal of signals of channels A and B is sampled at the sampling frequency f2 (f1>f2), the information after quantization is less than information required when individual sampling of channel A and B is performed at the sampling frequency f1. Similarly, when the sum signal of signals of channels A and B is sampled at the sampling frequency f1 and the above-mentioned differential signal is sampled at the sampling frequency f2, the required information is less than the information required for sampling of each channel A and B. Therefore, when the data is stored in the memory after conversion to digital signal, the required memory capacity can be reduced as compared to the memory capacity required for individual storage of signal of each channel. Moreover the signal transmission time is shorter than the transmission required to individually the signals of each channel.

BRIEF DESCRIPTION OF THE DRAWINGS

The invention will now be described with reference to the accompanying drawings wherein:

FIG. 5(A) and FIG. 5 (B) show how data is stored in the memory.

DESCRIPTION OF THE PREFERRED EMBODIMENT

Figure 1A:
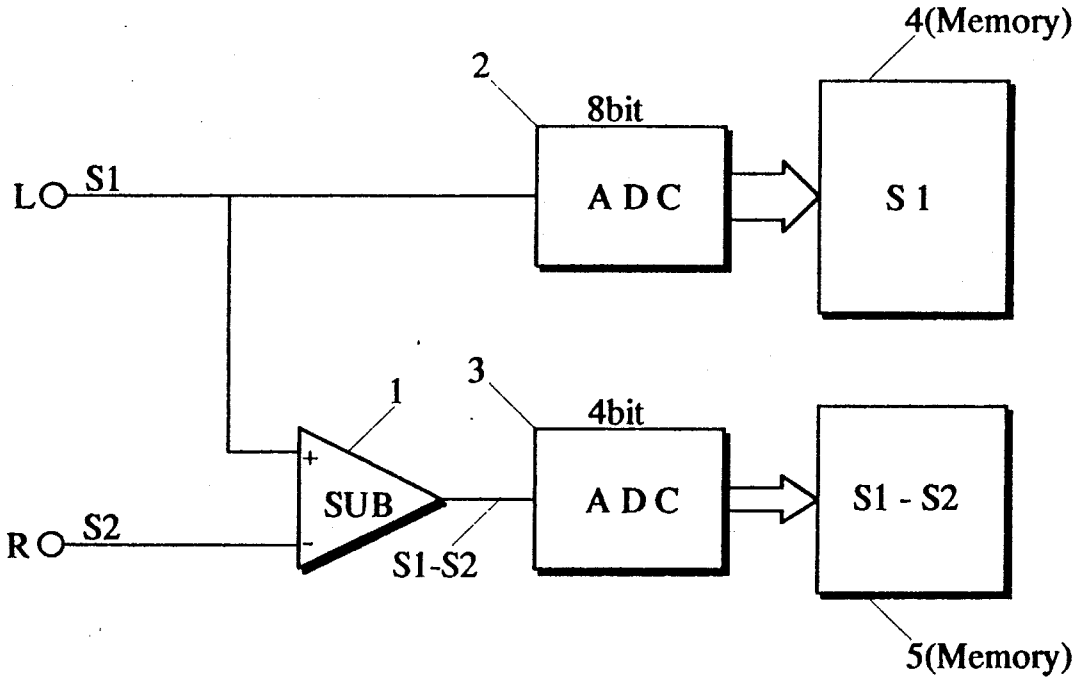
FIG. 1 (A) and FIG. 1 (B) show the basic configuration of the equipment for embodying the invention.
Figure 1B:
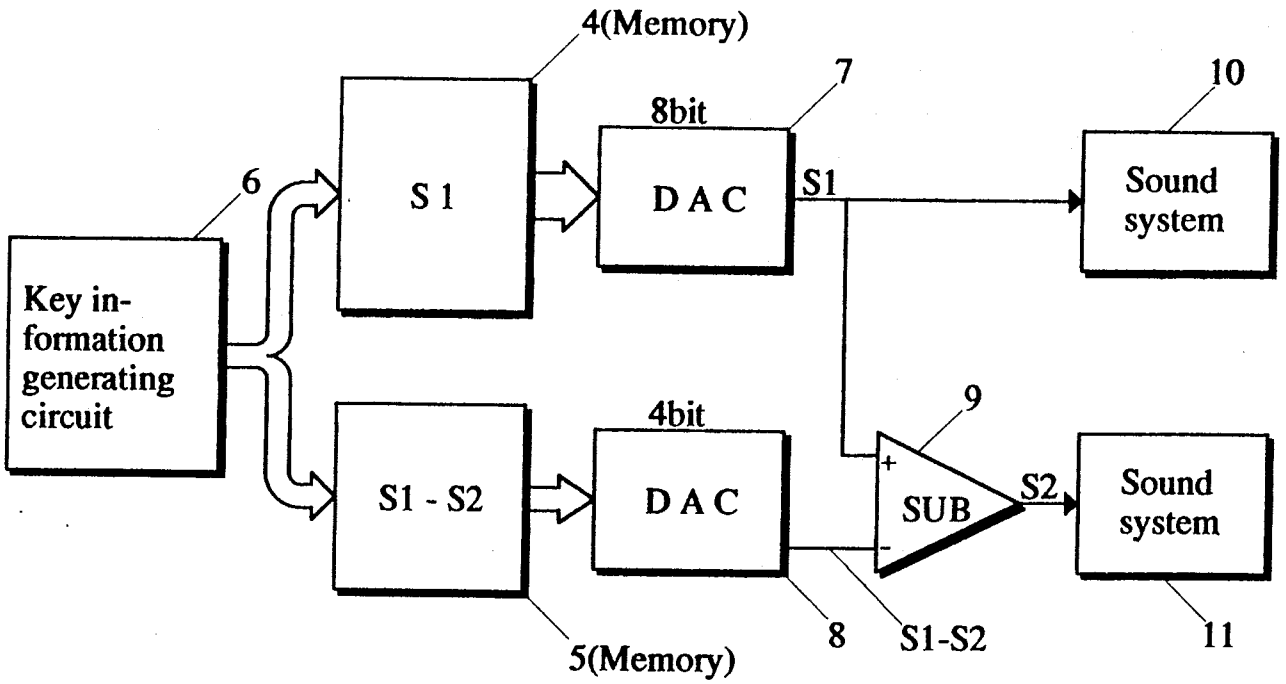

FIG. 1 (A) and FIG. 1 (B) are the basic block diagrams of the equipment for embodying the 1st signal compressing method of the invention. In this example of embodiment, for simpler explanation, the signal to be processed here is assumed to be a stereo signal comprising L signal and R signal, and two channels (L channel and R channel) are used. The compressed digital signal is assumed to be stored in the memory as PCM data. An electronic musical instrument having a keyboard is taken as an example of reproducing equipment.

FIG. 1 (A) shows the configuration of the equipment (sampler) for compressing the stereo signal of L channel and R channel and storing it in the memory.

In this figure, when the signal s1 of L channel and the signal s2 of R channel are inputted into a subtractor SUB, the signal s1 of L channel is inputted into an 8-bit AD converter 2. In the subtractor SUB the signal s2 of R channel is subtracted from the signal s1 of L channel, and the obtained differential signal (s1−s2) is outputted to a 4-bit AD convert 3. Accordingly, in the 8-bit AD converter 2 only the signal s1 of L channel is AD-converted and in the 4 bit AD converter 3 only the differential signal (s1−s2) of the signal s1 of L channel and signal s2 of R channel is AD-converted. The 8-bit data AD-converted by the 8-bit AD converter 2 is stored in a memory 4 whereas the differential signal (s1−s2) data AD-converted by the 4-bit AD converter 3 is stored in a memory 5. The data to be stored in the memories 4 and 5 is assumed here to be stored for each tone color (piano and guitar). It is also assumed that the data quantized by the AD converters 2 and 3 (8-bit quantized data or 4-bit quantized data) is further converted to the PCM data by the coding circuit included in the AD converter. In the configuration mentioned above the signal s1 of L channel is quantized with 8 bits in the AD converter 2, and the differential signal (s1−s2) of the signal s1 of L channel and the signal s2 of R channel is quantized with 4 bits in the AD converter 3. Since the signals s1 and s2 are stereo signals, there is a close correlation between them. Consequently, the amplitude of the differential signal thereof (s1−s2) is fairly smaller than the amplitude of individual signal s1 of L channel and individual signal s2 of R channel. Even when the amplitude information is quantized with 4 bits, the dynamic range does not lower at all. The data stored in the memories 4 and 5 feature as follows. Output of 8-bit AD converter 2 is 8-bit signal, whereas output of 4-bit AD converter 3 is 4-bit signal. Accordingly, as compared to the case where the signal s1 of L channel and the signal s2 of R channel are individually AD-converted, there occurs a compression of (8−4) bits. Accordingly, the total capacity of memories 2 and 3 is reduced by the quantity corresponding to such a compression. Concretely, the memory capacity which can be saved is ¼ since the required capacity of memory 5 is equal to ½ of the capacity of memory 4.

Since the data stored in the memory 5 is the differential signal (s1−s2) data, the s2 data can be restored by subtracting the differential signal data from the s1 data. FIG. 1 (B) shows an electronic musical instrument which is designed to output sound by reproducing the signal s1 of L channel and the signal s2 of R channel by the above-mentioned method. In FIG. 1 (B) the key information generating circuit 6 generates a memory address corresponding to the key pressed by the player, and the generated address is given to the memories 4 and 5. When this address is generated, the memories 4 and 5 output the s1 data and the (s1−s2) data which are the musical tone data stored in specific address. They are outputted to the 8-bit DA converter 7 and the 4-bit DA converter 8 where the signals are DA-converted. The number of bits in the DA converters 7 is 8 whereas the number of bits in the DA converter 8 is 4. This is due to that the s1 data is 8-bit data whereas the (s1−s2) data is 4-bit data. The signal s1 and differential signal (s1−s2) which are DA-converted in the DA converters 7 and 8 are subtracted in a subtracting circuit 9. Consequently, the output of subtracting circuit 9 is s2. At this stage the stereo signal is completely reproduced, and the signals s1 and s2 are outputted to the sound systems 10 and 11, respectively.

Figure 2:
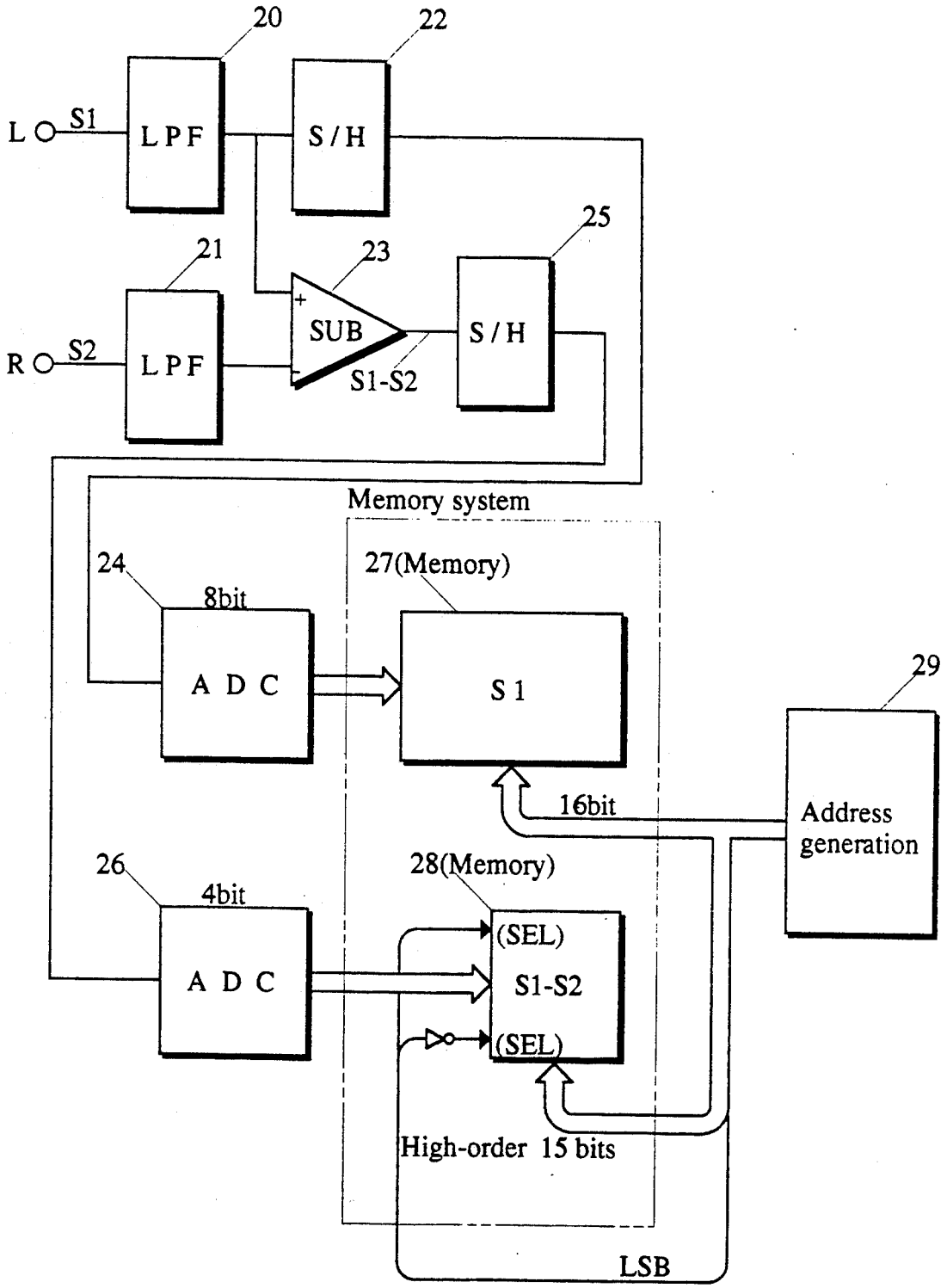
FIG. 2 and FIG. 3 show the concrete configuration of the equipment shown in FIG. 1.
Figure 3:
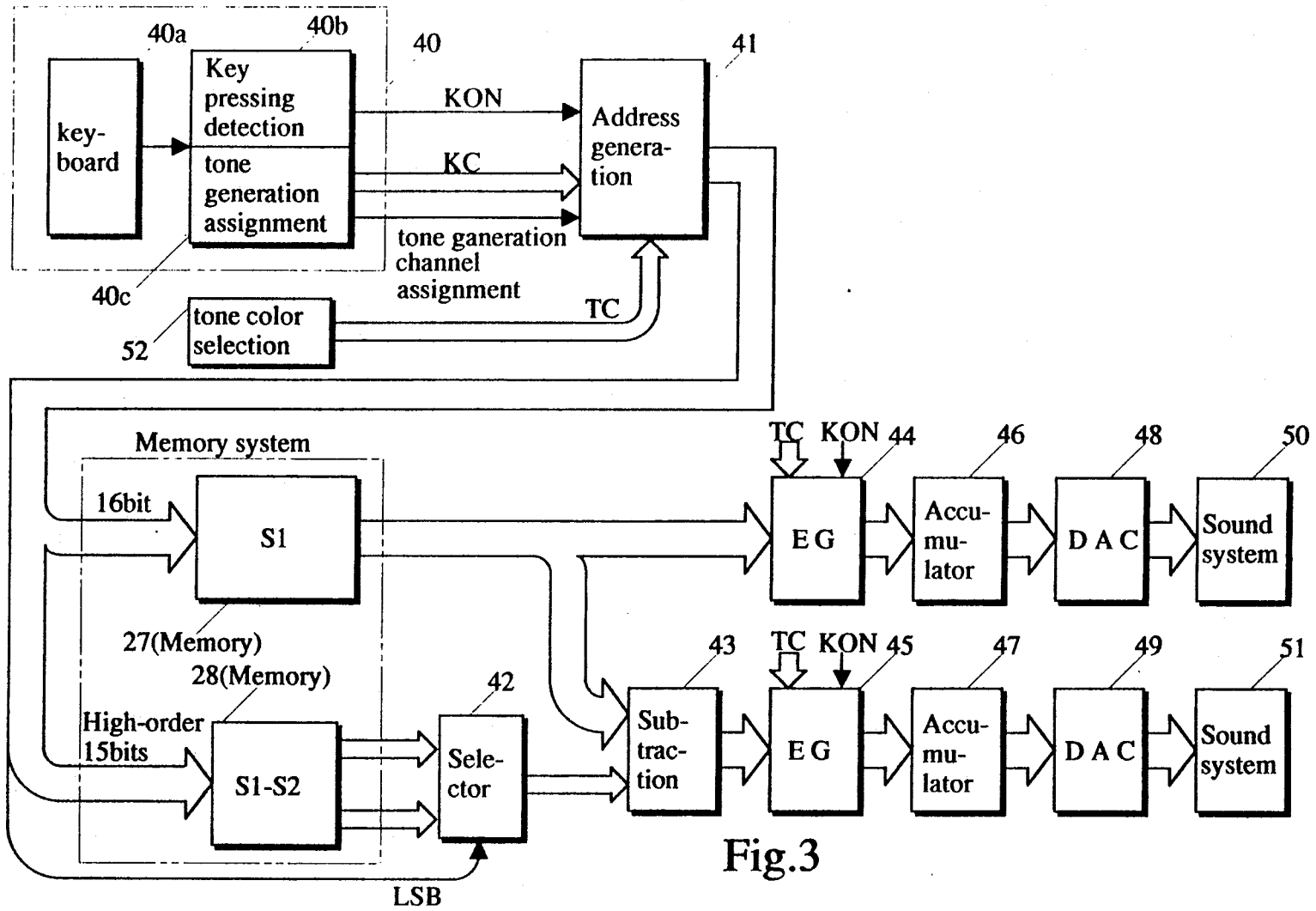

FIG. 2 and FIG. 3 show the detailed configuration of the example of embodiment shown in FIG. 1. In FIG. 1 the subtracting circuit at the stage of signal reproduction is provided at the rear stage of DA converter whereas in FIG. 3 the subtracting circuit is provided at the rear stage of memory so that subtraction is performed before signal is sent to the the DA converter.

FIG. 2 shows an equipment (sampler) which compresses the stereo signal comprising the signal s1 of L channel and the signal s2 of R channel, converts the signals to the PCM data and stores the data in the memory.

The low pass filters 20 and 21 are designated to remove the high frequency components of signals s1 and s2, respectively. The signal s1 which passed the filter is led to the sample hold circuit 22 and to the input terminal (positive terminal) of subtracting circuit 23. The signal s2 which passed the filter 21 is led to the input terminal (negative terminal) of the above-mentioned subtracting circuit 23. The signal s1 is sample-held in the sample hold circuit 22 and outputted to the 8-bit AD converter 24. The subtracting circuit 23 takes out a differential signal (s1−s2) of signals s1 and s2 and outputs it to the sample hold circuit 25. The signal which has been sample-held in the sample hold circuit 25 is outputted to the 4-bit AD converter 26. As explained, referring to FIG. 1, the stereo signals s1 and s2 have a close correlation between them. Therefore, the amplitude level of the differential signal (s1−s2) is substantially smaller than that of individual signal s1 and s2. Accordingly, even when this differential signal (s1−s2) is quantized with 4 bits, complete reproduction is possible without lowering the dynamic range.

The 8-bit AD converter 24 and the 4-bit AD converter 26 have an AD converter for quantizing the analog signal and a coding circuit for converting the quantized data to PCM data by coding. The data coded by the AD converters 24 and 26 is led to a memory system. The memory system comprises a memory 27 for storing the 8-bit s1 data converted by the 8-bit AD converter and a memory 28 storing the 4-bit data (s1−s2 data) converted by the 4-bit AD converter 26.

Figure 4:
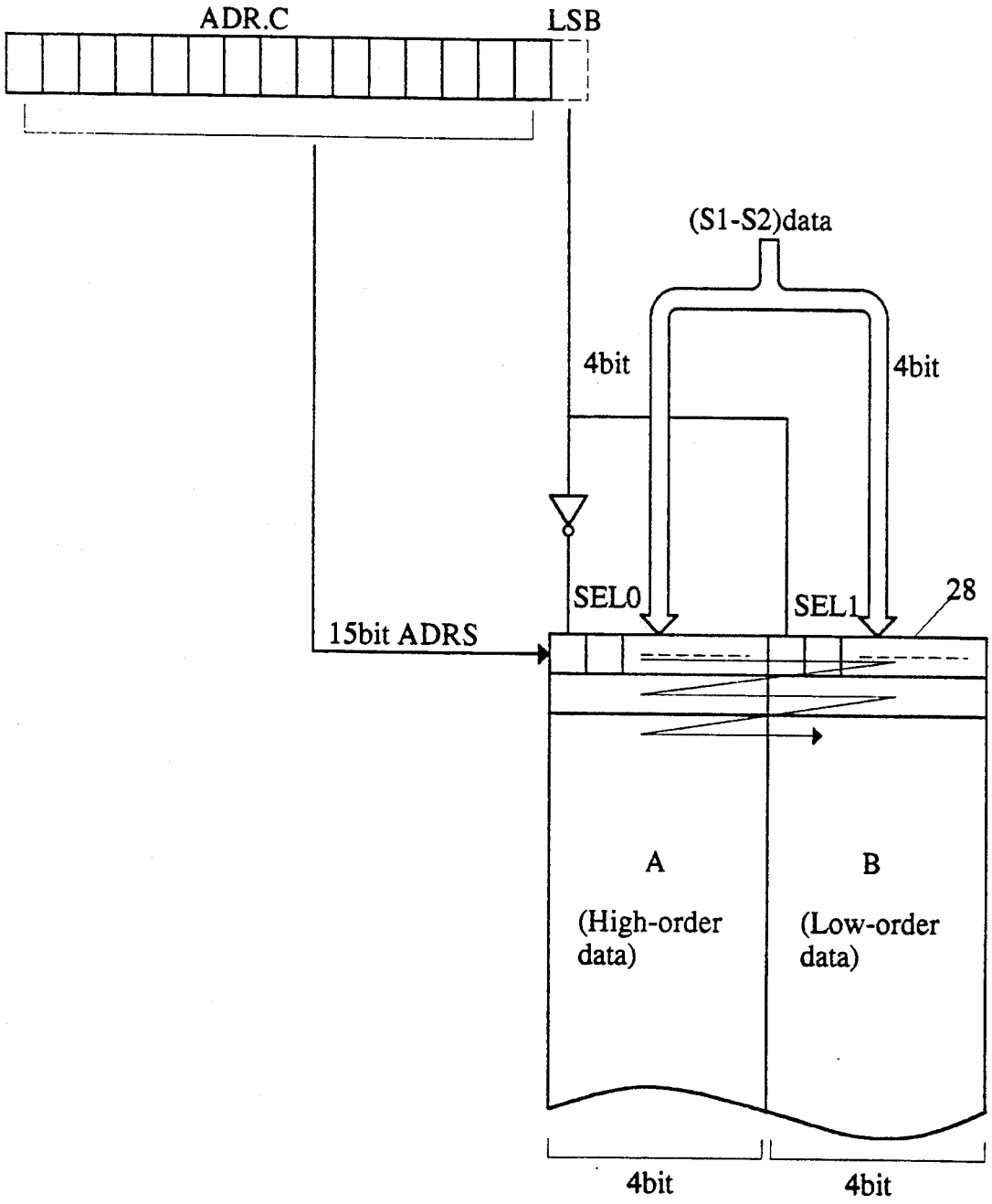
FIG. 4 shows a method of writing data in the memory 28 of the equipment shown in FIG. 2.

The address generating circuit 29 gives the common address information to the memories 27 and 28. The addressing is distinguished by tone colors. The 16-bit address information is all given to the memory 27. The high-order 15 bits are given to the memory 28 as address information. LSB is given to the memory 28 as chip select signal. FIG. 4 explains how the (s1−s2) data is written in the memory 28. The memory has a configuration featuring that the 4-bit memory blocks A and B are parallel connected. Each block (A and B) has a chip select terminal (SEL0 and SEL1). The LSB information of address counter (ADR. C) of address generating circuit 29 is directly given to the above-mentioned chip select terminal SEL1 and also to the above-mentioned chip select terminal SEL0 through an inverter. The (s1−s2) data is inputted commonly to the memory blocks A and B. Owing to such a configuration the 4-bit (s1−s2) data is stored in the memory A block as high-order data when LSB is "0", but when LSB is "1", the 4-bit (s1−s2) data is stored in the memory block B as low-order data. Consequently, when the count of address counter is incremented, the (s1−s2) data is successively stored in the direction of arrow mark shown in the figure.

Figure 5:
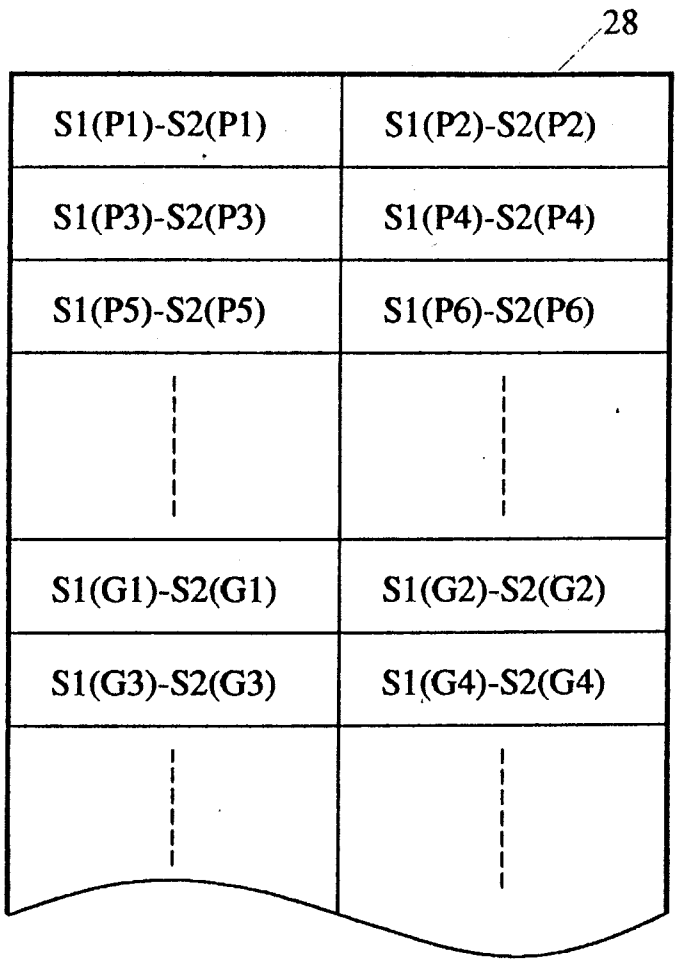
Figure 5:
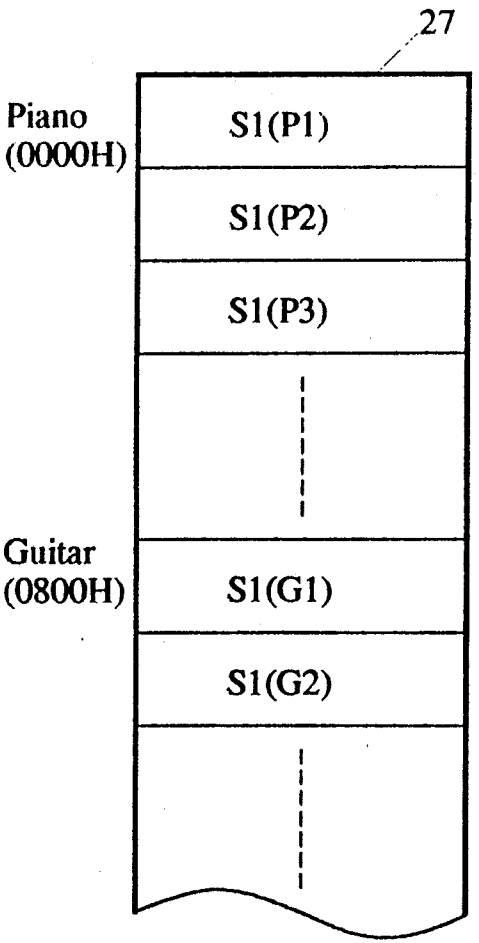

FIG. 5 (A) and FIG. 5 (B) show data storage state of the memories 27 and 28. In this example, the data (musical tone data) of piano tone color is stored at the address of 0000H to 07FFH in the memory 27 whereas the data (musical tone data) of guitar tone color is stored at the address of 0800H and below.

In the memory 28, the data of piano (musical tone data) is stored at the address of 0000H to 03FFH, and the data of guitar (musical tone data) is stored at the address of 0400H and below.

Next, below is given an explanation of the electronic musical instrument having a keyboard shown in FIG. 3.

Figure 6:
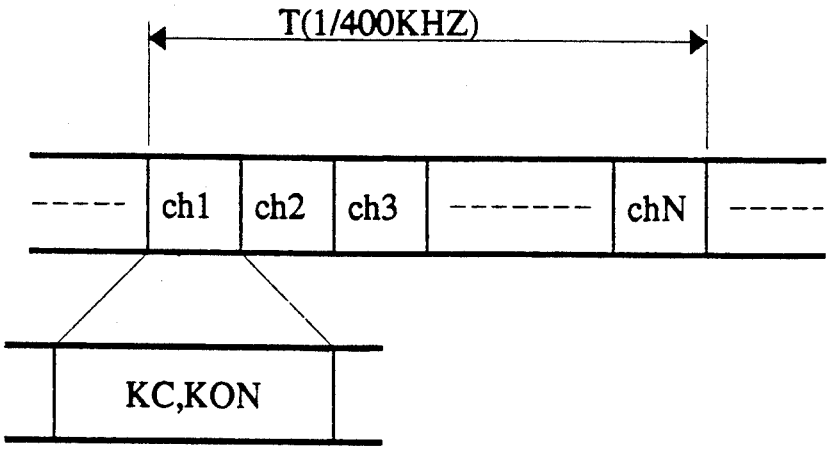
FIG. 6 shows the format of data which is inputted into an address generating circuit 41 of the equipment shown in FIG. 3.

A key information generating circuit 40 comprises a keyboard 40*a*, a key pressing detection circuit 40*b* and a tone generation assignment circuit 40*c*. The key pressing detection circuit 40*b* detects the key code of the pressed key of keyboard 40*a*. The tone generation assignment circuit 40*c* is designated to assign the key code of the key pressed by the player to a proper empty tone generation channel. In the key information generating circuit 40 having the above-mentioned configuration the key code KC of the key, pressing of which was detected, the tone generation channel to which this key code KC is assigned, and the key-on signal KON indicating that the key has been pressed are generated, and these signals are outputted to the address generating circuit 41. In this example of embodiment these key informations are sent to the address generating circuit by the time-shared system so that complex tone generating can be performed simultaneously. FIG. 6 shows a format of key information sent to the address generating circuit 41. As shown in the figure, the key code KC assigned to each channel and the key-on signal KON are sent successively from the channel Ch1 every T time. Here, the time-shared repetition frequency is 400 kHz. The key code KC assigned to the channel of time slot and the key-on signal KON are located in each time-shared time slot. Here, the key-on signal is data "1" or "0". The signal "1" indicates that the key of key code KC located in the pertinent time slot is in pressed state.

Moreover, the tone color selection signal TC is inputted to the address generating circuit 41 from the tone color selection circuit 42. The tone color selection circuit 42 is designated to select tone color such as piano and guitar. It incorporates a tone color selection switch not shown in the figure. The tone color selection signal TC is used to specify the musical tone data storage area for each tone color stored in the memories 27 and 28 or the start address of this area in the address generating circuit 41. Receiving the tone color selection signal TC, the address generating circuit 41 specifies the addressing range in the musical tone data storage range of the memories 27 and 28. For example, when the tone color selection signal TC selects the piano, it specifies the range from 0000H to 07FFH of the memory 27, as well as the range from 0000H to 03FFH of the memory 28.

The address generating circuit 41 generates successively the address corresponding to the key code KC inputted as key information in the musical tone data storage area of the memories 27 and 28 which is specified according to the tone color selection signal TC. This successive address information corresponds to so-called phase data which specifies the frequency of musical tone signal waveform. The technology to give the phase data as an address information to the memory which stores the musical tone signal data is well known.

Figure 7A:
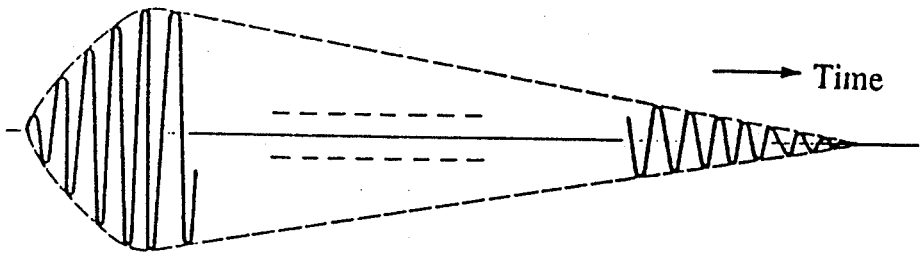
FIG. 7 (A), (B) and (C) show an example of storing the musical tone signal waveform of several periods in the memory.
Figure 7B:
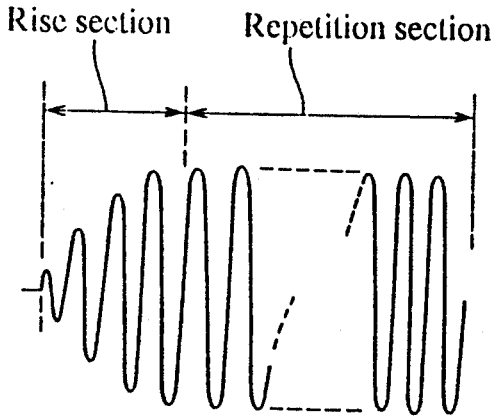
Figure 7C:
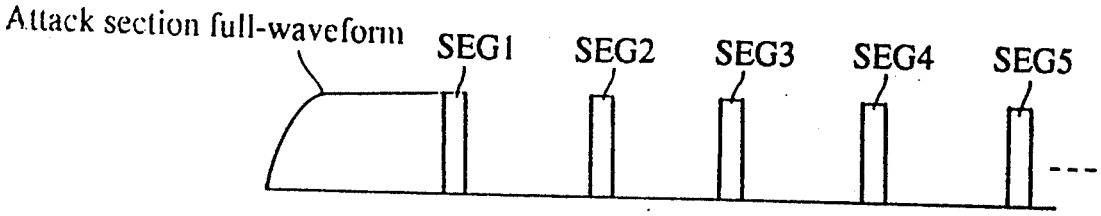

The musical tone data to be stored in the memory mentioned above can be composed also as musical tone data of several periods. FIG. 7 (A) and FIG. (B) show the examples of waveform of musical tone signal having several periods. The waveform shown in FIG. 7 (A) is an example of storage of whole waveform from the beginning to the end of tone generating (attack-decay). This method features that the whole waveform is once read when the key is pressed. FIG. 7 (B) shows an example of storage of the rise segment (attach segment) and the subsequent partial waveform (repetition segment). This method features that the rise segment is once read and then the repetition segment is read repeatedly several times. In the latter case the whole waveform of attack segment and the several sampling waveforms (SEG1, SEG2, . . . . ) properly sampling-selected from the subsequent waveform are stored in the memory as shown in FIG. 7 (C). Data is read as follows. The attack segment is once read, and then SEG1 is read repeatedly N1 times, after that SEG2 is repeatedly read N2 times, and subsequently SEG3, SEG4 . . . are repeatedly read as many times as necessary. The method shown in FIG. 7 (B) and FIG. 7 (C) has an advantage that the required memory capacity is less than the memory capacity required for the method shown in FIG. 7 (A).

Figure 8:
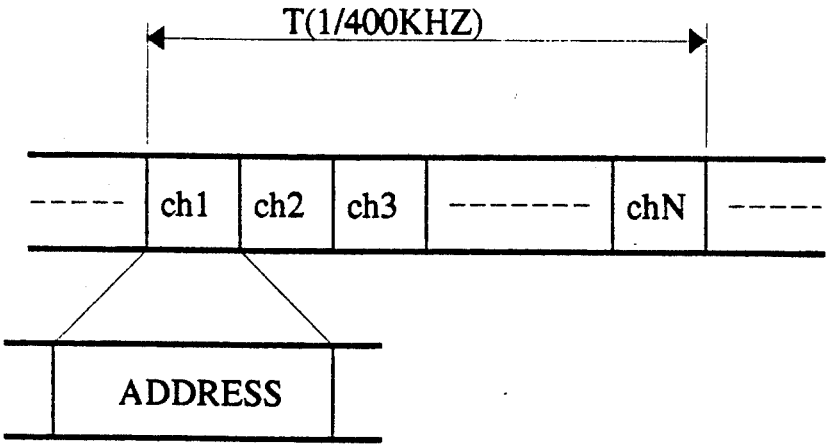
FIG. 8 shows the format of address data outputted from the address generating circuit of the equipment shown in FIG. 3.

The address data is outputted from the address generating circuit 41 as phase data as mentioned above. Similarly to the above-mentioned procedure of sending the key pressing information, this address data is also sent by time-shared processing as shown in FIG. 6. Accordingly, the data outputted from the address generating circuit 41 has a format shown in FIG. 8.

The musical tone data are stored as 8-bit data and 4-bit data in the memories 27 and 28 as shown in FIG. 5 (A) and FIG. 5 (B), respectively. The musical tone data (S1 − S2) of memory 28 is outputted to the selector circuit 42 together with the high-order data of block A and the low-order data of block B. The 16-bit address data outputted from the address generating circuit 41 is all given to the memory as address information. The high-order 15 bits thereof is given to the memory 28 as address information. LSB is sent to the selector circuit 42 as selector signal to select the above-mentioned high-order data and low-order data. This selector circuit 42 is a circuit which outputs signal to the latter stage, selecting either the high-order data or the low-order data mentioned above based on the data of LSB.

Figure 9:
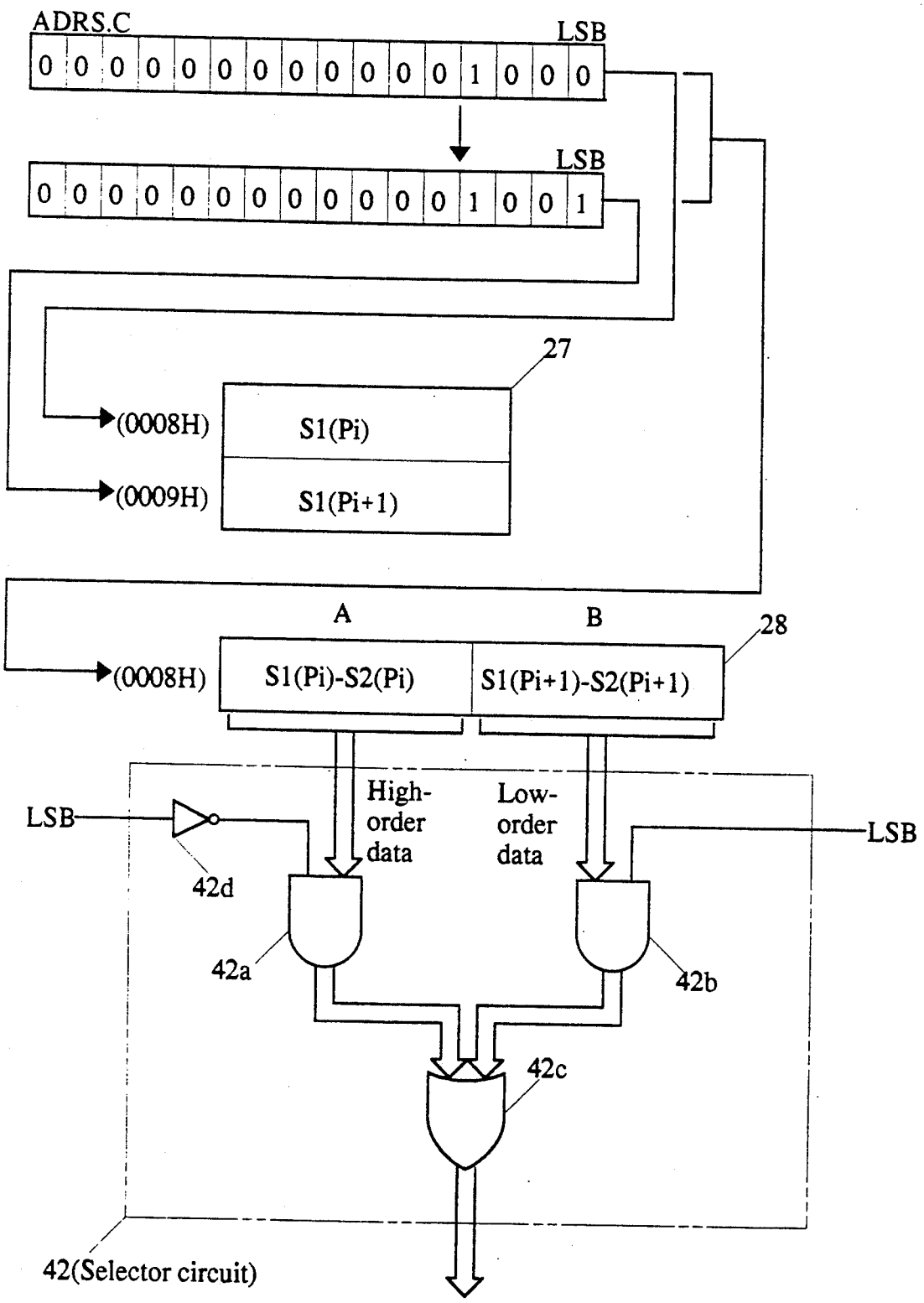
FIG. 9 shows the configuration of the selector circuit and the memory addressing.

FIG. 9 shows the configuration of the selector circuit 42 and the addressing procedure for the memories 27 and 28. The selector circuit 42 comprises two AND circuits 42*a* and 42*b*, an OR circuit 42*c* and an inverter 42*d*, as shown in the figure. The high-order data of block A and the low-order data of block B of the memory 28 is outputted to the AND circuits 42*a* and 42*b*, respectively.

LSB, one of 16-bit address data outputted from the address generating circuit 41, is directly inputted to the AND circuit 42*b* and to the AND circuit 42*a* through the inverter 42*d*. Outputs of AND circuits 42*a* and 42*b* are ORed by the OR circuit 42*c*, and the obtained data is outputted to the later stage.

Let us assume that the address value outputted from the address generating circuit 41 advances from 0008H to 0009H. At this time s1(Pi) data→s1(Pi+1) data are successively outputted from the memory 27. These data are all 8-bit data. Since only the high-order 15-bit address data is given to the memory as address information, the address specified in the memory 28 remains to be 0008H even when the address advances from 0008H to 0009H. Since LSB is "0" when address is 0008H, and LSB is "1" when the address is 0009H, the AND circuit 42*a* opens in the former case but in the latter case the AND circuit 42*b* opens. Accordingly, when the address is 0008H, the high-order data of the block A of memory 28 appears in the output of OR circuit 42*c*, and when the address is 0009H, the low-order data of block B of memory 28 appears. Consequently, when the s1(Pi) data is outputted from the memory 27, the high-order data, namely the data of block A of memory 28, is outputted from the selector circuit 42, and when the s1(Pi+1) data is outputted from the memory 27, the low-order data of block B of memory is outputted from the selector circuit 42.

Since the configuration of selector circuit 42 and the addressing of memories 27 and 28 are as stated above, the data read from the memory system is identical with the data which is written in the memory system with the equipment (sampler) shown in FIG. 2.

The output of the selector circuit 42 and the output of memory 27 are led to the subtracting circuit 43 where subtraction s1 − (s1 − s2) is performed. As a result of this subtraction the data of s1 − (s1 − s2) = s2 appears in the output of subtracting circuit.

The s1 data outputted from the memory 27 and the s2 data outputted from the subtracting circuit 43 are led to the envelop generators 44 and 45 where amplitude modulation is performed. The tone color selection signal TC outputted from the tone color selection circuit 42 and the key-on signal KON outputted from the key information generating circuit 40 are led to the envelop generators 44 and 45 (hereinafter referred to as EG). In the EG44 and 45 the input data is amplitude-modulated according to the tone color selection signal TC, and the amplitude-modulated signal is outputted synchronizing with the key-on signal KON. The signals amplitude-modulated by EG 44 and 45 are accumulated in the accumulators 46 and 47, respectively. The data flow to the accumulators 46 and 47 is all controlled by the time-shared processing with the format shown in FIG. 6 and FIG. 8. In the accumulators 46 and 47 the time-shared data for the n channels, namely data for each T time, is accumulated. Accordingly, since the repetition frequency in this example of embodiment is 400 kHz, the period of the data after passing the accumulators 46 and 47 is (1/400 kHz). The data from the accumulators 46 and 47 is outputted to the DA converters 48 and 49 where it is converted to analog signal which is outputted to the sound systems 50 and 51 wherefrom signal is outputted as sound.

In this example of embodiment the storage and reproduction are individually explained. The compressing method of the invention is applicable even when data is stored in the memory at the stage of fabrication and only the reproduction is performed. Several waveforms corresponding to compass can be stored in the memory.

Moreover, in the example of embodiment the stereo signal comprising L channel signal s1 and R channel signal s2 can be compressed by using the above-mentioned configuration. This signal compression enables reduction of memory system capacity to $\frac{3}{4}$ as compared to the memory system designed to store individually signals of each channel.

Figure 10:
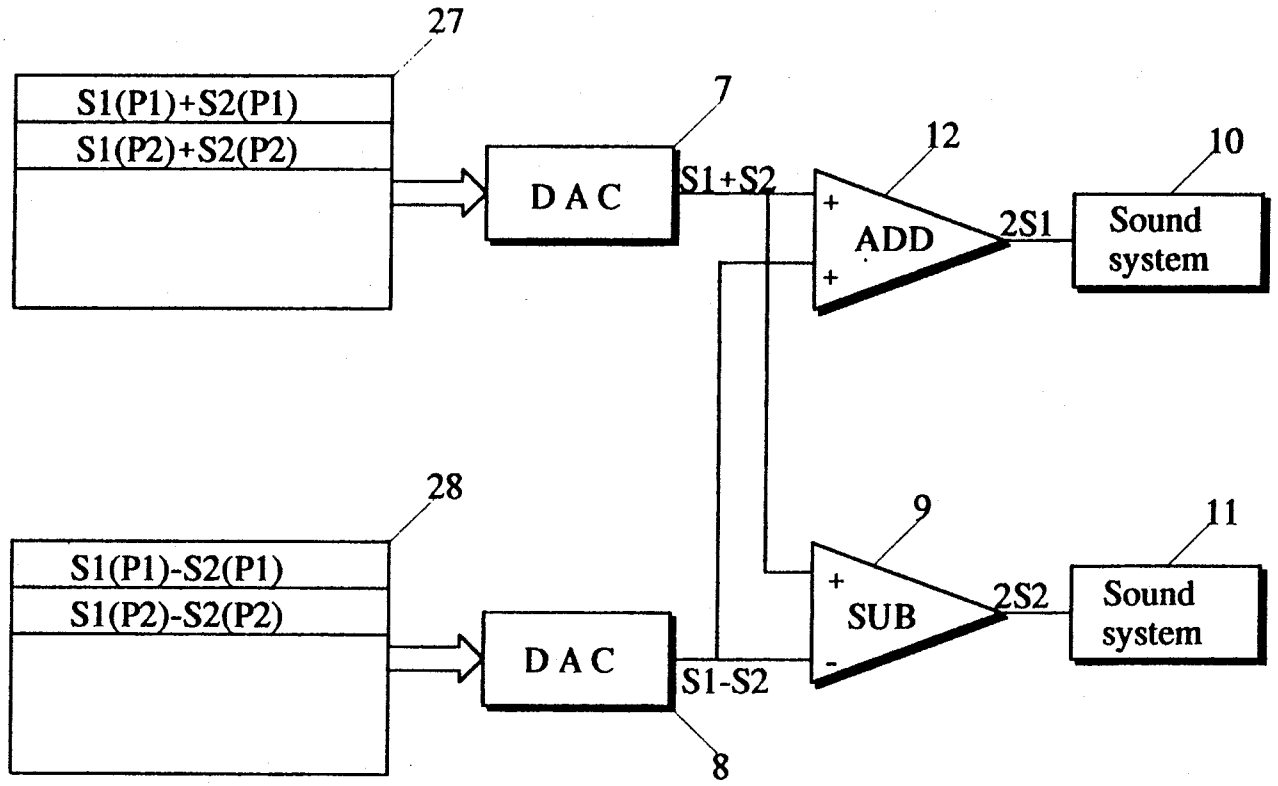
FIG. 10, FIG. 11 (A) and FIG. 11 (B) show other examples of embodiment of the 1st method of the invention.

In this example of embodiment the number of channels is two, namely L channel and R channel. As a matter of course, this invention is applicable also to signals of more than two channels. Furthermore, in this example of embodiment the applied configuration is such that the signal s1 of one channel (L channel) is individually stored in the memory 27. It is possible to store the sum signal, including the signal s2 of other channel (R channel). FIG. 10 shows the configuration of the memory and data read section which is applicable when the sum signal of signal s1 of L channel and s2 signal of R channel is stored in the memory 27 and the differential signal thereof is stored in the memory 28. In this example, the configuration differs from the configuration shown in FIG. 1 (B) in that an adding circuit 12 to add the (s1+s2) data to (s1−s2) data is provided. At the stage where the data is outputted to the sound systems 10 and 11 the s1 signal components and the s2 signal component are completely separated. In this case, too, the capacity of memory 28 can be reduced by the same reason as that stated above in the example of embodiment above.

Figure 11B:
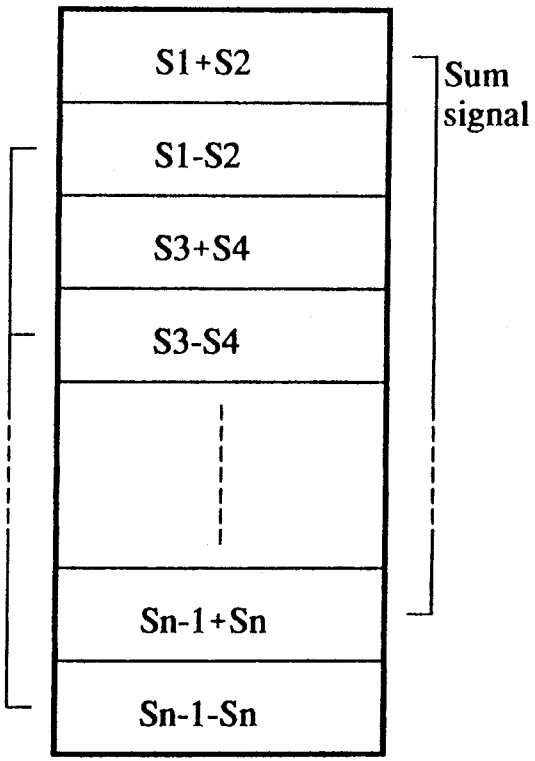
Figure 11A:
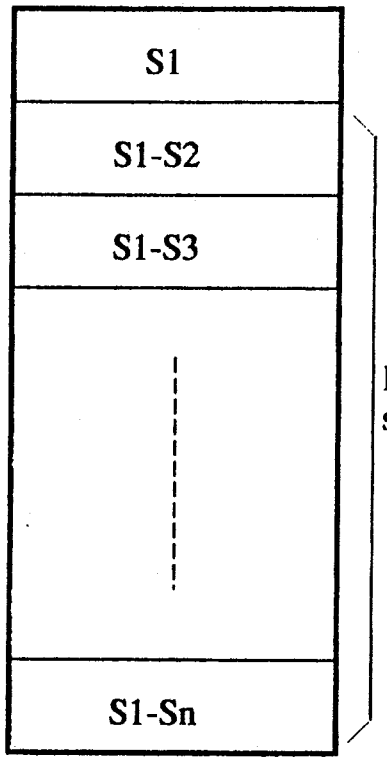

In this example of embodiment, an explanation of signal compressing method for the two channels (L channel and R channel) is given. This invention is applicable also for signal compression of more than two channels. FIG. 11 shows a combination for signal synthesis when the signals for n channels (n>2) are compressed. This figure shows an example where the signals for n channels are composed by combination of signal s1 of channel ch1 and (n−1) differential signals, namely (s1−s2), (s2−s3), . . . (s1 −sn). In the example shown in FIG. 11 (B), the signal of N channel is composed by combining the sum signal (s1+s1), (s3+s4), . . . . . (sn−1+sn) and the differential signal (s1 −s2), (s3−s4), . . . (sn−1−sn). In any case the differential signal can be compressed. When these signals are stored in the memory, required capacity of memory can be reduced significantly.

Figure 12A:
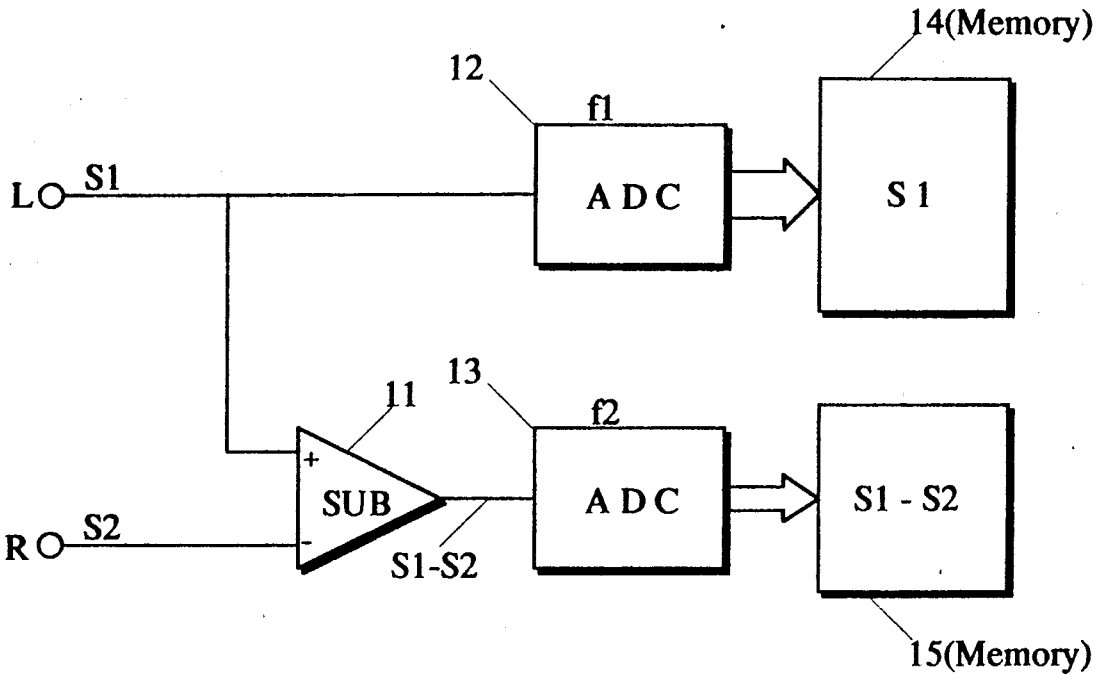
FIG. 12 (A) and FIG. 12 (B) show the basic configuration of the equipment for embodying the 2nd method of the invention.
Figure 12B:
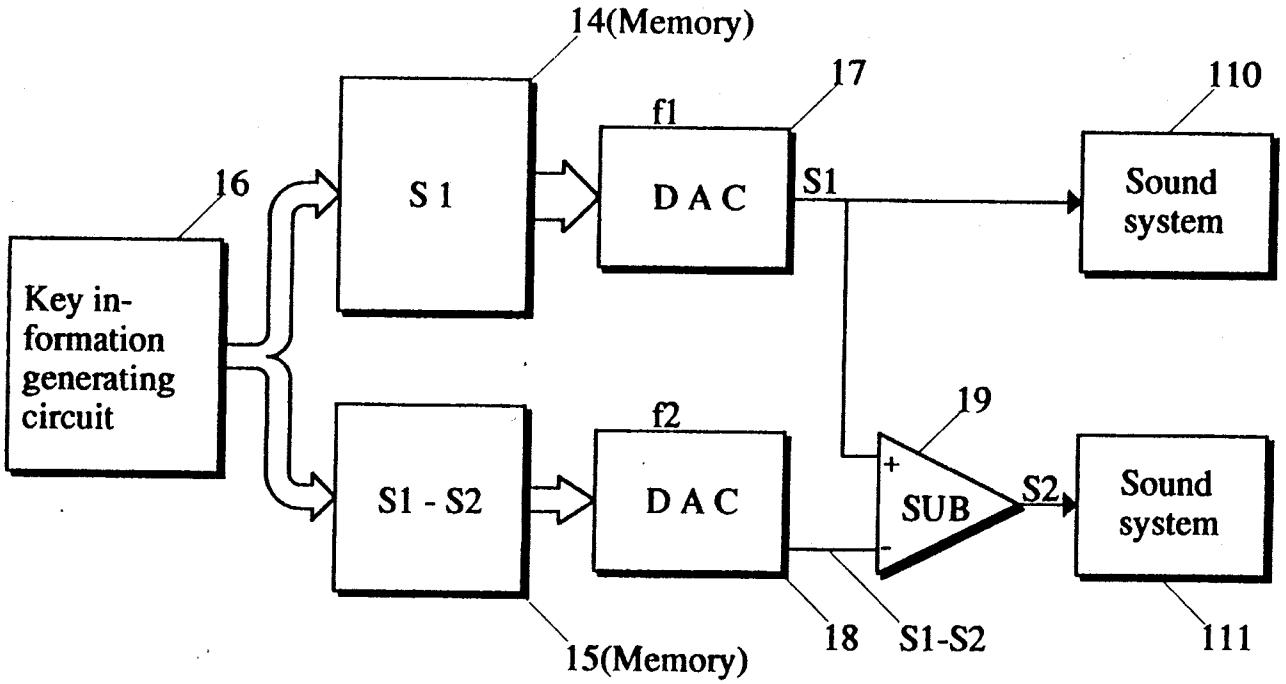

FIG. 12 (A) and FIG. 12 (B) are the basic block diagrams of the equipment in which the 2nd signal compression method of this invention is embodied. In this example of embodiment, for simpler explanation, the signal to be processed is assumed to be stereo signal comprising the L signal and R signal, and the number of channels is assumed to be 2 (L channel and R channel). The digital signal, namely compressed signal, is assumed to be stored in the memory as PCM data. An electronic musical instrument having a keyboard is shown as an example of the reproducing equipment.

FIG. 12 (A) shows the configuration of an equipment (sampler) designated to compress the stereo signal of L channel and R channel and to store it in the memory. In this figure the signal s1 of L channel and the signal s2 of R channel are inputted to the subtracting circuit 11, and at the same time the signal s1 of L channel is inputted to an 8-bit AD converter 12 whose sampling frequency is f1. In the subtracting circuit 11 the signal s2 of R channel is subtracted from the signal s1 of L channel, and the obtained differential signal (s1−s2) is outputted to an 8-bit AD converter 13 whose sampling frequency is f2. Accordingly, the 8-bit converter 12 performs AD-conversion of only the signal s1 of L channel with the sampling frequency f1 whereas the 8-bit AD converter 13 performs AD conversion of only the differential signal (s1−s2) of signal s1 of L channel and signal s2 of R channel with the sampling frequency f2. Here, the relation between the sampling frequencies f1 and f2 is expressed as follows:

$$f1>f2$$

Figure 13A:
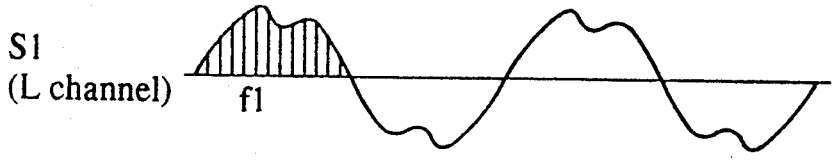
FIG. 13 (A), (B) and (C) explain the operation of the AD converter at the equipment shown in FIG. 12 (A).
Figure 13B:
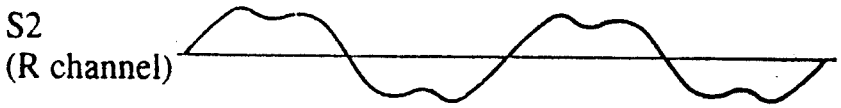
Figure 13C:
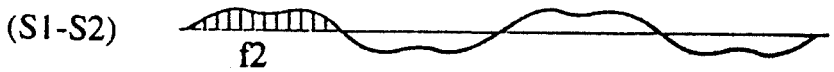

FIG. 13 shows the signal s1 of L channel, the signal s2 of R channel and the differential signal thereof (s1−s2). In this example of embodiment the sampling frequency f1 for sampling the signal s1 is set to 44 kHz. In this example of embodiment the sampling frequency for sampling the differential signal (s1−s2) is set to 22 kHz.

The 8-bit data which has been AD-converted by the AD converter 12 whose sampling frequency is f1 (44 kHz) is stored in the memory 4 as musical tone data. The above-mentioned 8-bit differential signal (s1−s2) data which has been AD-converted by the AD converter 15 whose sampling frequency is f2 (22 kHz) is stored in the memory 15 as musical tone data. Here, it is assumed that data are stored in the memories 14 and 15 for each tone color (piano and guitar, etc.) as musical tone data. It is assumed that the data quantized by the AD converters 12 and 13 are really converted to PCM data by a coding circuit included in the AD converter and then stored in the memories 14 and 15.

In the configuration stated above the signal s1 of L channel is sampled with a sampling frequency f1 (44 kHz) in the AD converter 12, and the differential signal (s1−s2) of signal s1 of L channel and the signal s2 of R channel is sampled with a sampling frequency f2 (22 kHz) in the AD converter 13. Since the signals s1 and s2 are stereo signals, there is a close correlation between them, and subsequently the stereo feeling caused by the difference in the ranges of these signals is wholly weak. Even when the frequency band of the differential signal (s1−s2) is lower than the frequency range of individual signal s1 of channel L or signal s2 of channel R, sound quality is less degraded in reproduction mode. It is evident from the data thus stored in the memories 14 and 15 that since the sampling frequency f2 at the AD converter 13 is equal to ½ of sampling frequency f1 of AD converter 12, one data is written in the memory 15 while two data are written in the memory 14. Namely, the differential signal (s1−s2) data is stored in the memory as compressed data. Consequently, the total capacity of memories 14 and 15 is reduced by the value corresponding to the compression. Concretely, since the required capacity of memory 15 is ½ of capacity of memory 14, the memory capacity can be saved wholly totally by ¼.

Since the data stored in the memory 15 is differential signal (s1−s2) data, the s2 data can be restored by subtracting the (s1−s2) data from the s1 data stored in the memory 14. FIG. 12 (B) shows an electronic musical instrument which outputs sound, restoring the signal s1 of L channel and the signal s2 of R channel by the method mentioned above. In FIG. 12 (B) the key information generating circuit 16 generates the memory address which changes with a period corresponding to the pressed key, and the generated address is given to the memories 14 and 15. When this address is generated, the s1 data, which is the musical tone data stored at pertinent address, and the (s1−s2) data are outputted from the memories 14 and 15. They are outputted to the 8-bit DA converter 17 and the 8-bit DA converter 18, respectively, where they are DA-converted. The DA conversion frequency (conversion rate) of these DA converters 17 and 18 are identical with the sampling frequency of AD converters 12 and 13. Namely, the DA conversion frequency of DA converter 17 is set to f1 (44 kHz) but the DA conversion frequency of DA converter 18 is set to f2 (22 kHz). The reason why such a setting is applied is that DA conversion must be performed in the DA converters 17 and 18 with a frequency equal to the sampling frequency of the AD converters 12 and 13 for restoring correctly the initial analog signals so that the signals are sampled with the sampling frequency f1 and f2 and stored in the memories 14 and 15, respectively. The signal s1 DA-converted by the DA converters 17 and 18 and the differential signal (s1−s2) are subtracting in the subtracting circuit 19. Therefore the output of subtracting circuit 19 is s2. In this stage the stereo signal is completely reproduced, and the signals s1 and s2 are outputted to the sound systems 110 and 111.

Figure 14:
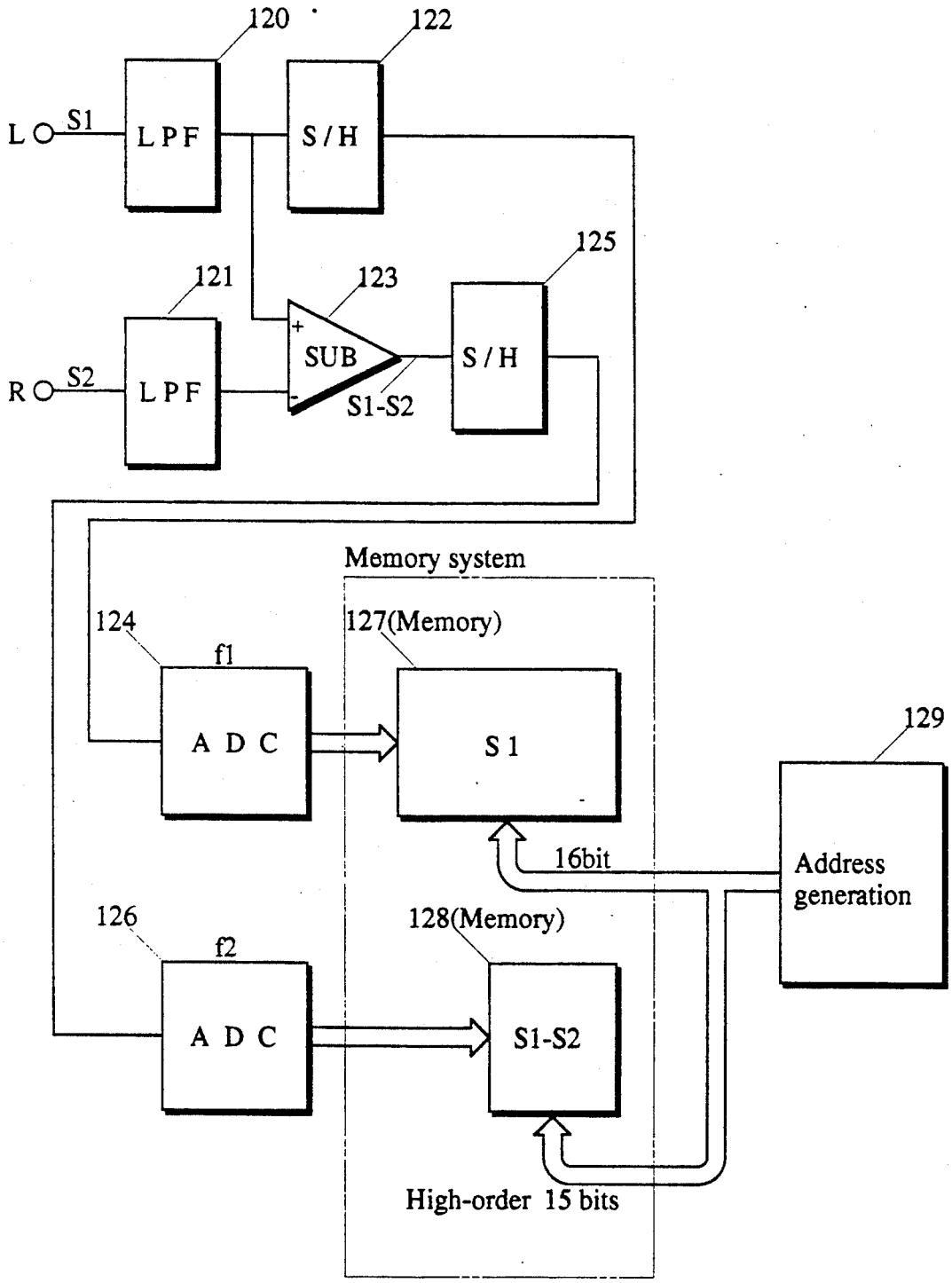
FIG. 14 and FIG. 15 show the concrete configuration of the equipment shown in FIG. 12.
Figure 15:
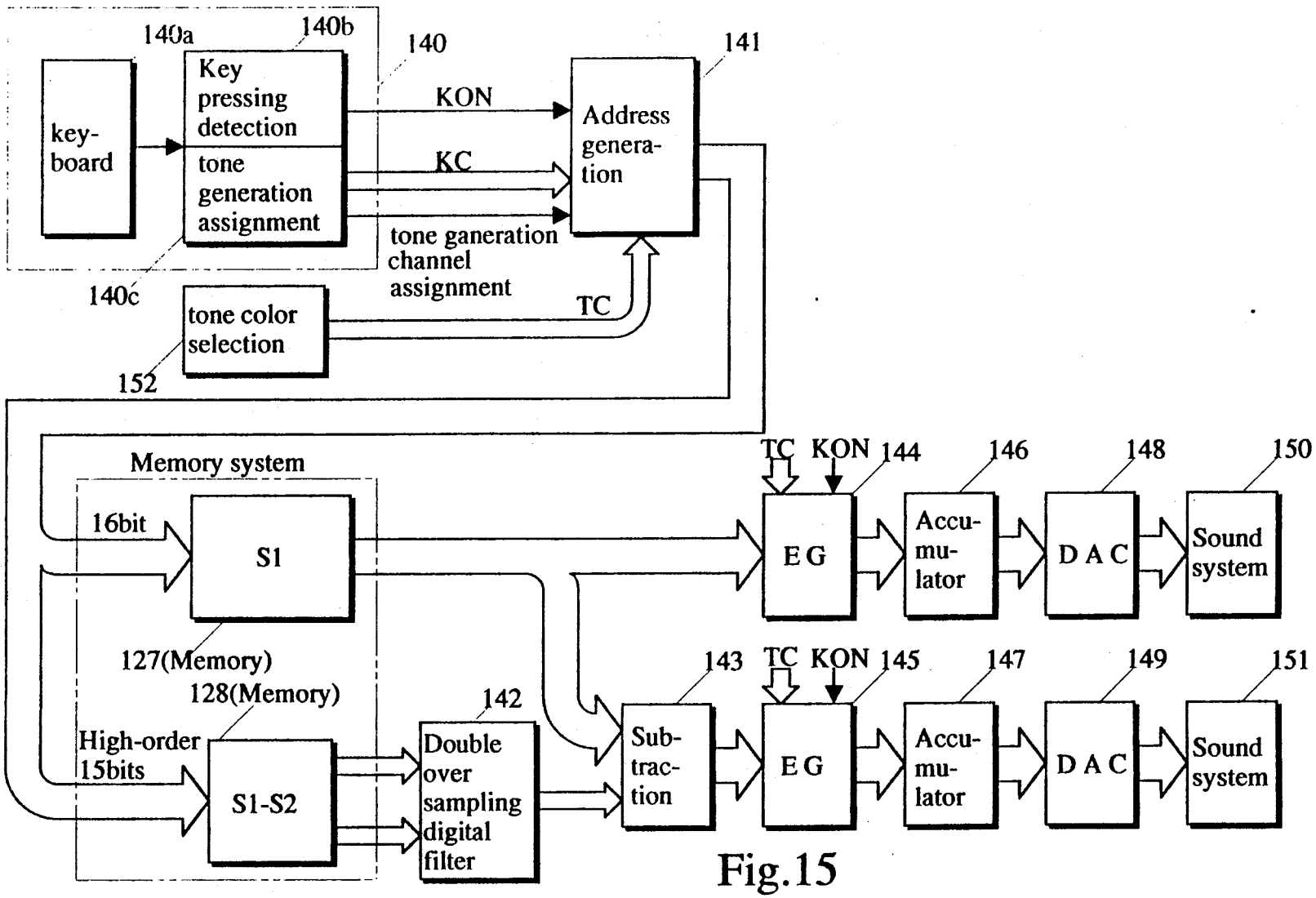

FIG. 14 and FIG. 15 show more comprehensively the example of embodiment which is shown in FIG. 12. In FIG. 12 the subtracting circuit of signal reproduction stage is provided at the latter stage of DA converter but in FIG. 15 the subtracting circuit is provided at the latter stage of memory so that subtraction is performed as digital value before it is passed through the DA converter.

FIG. 14 shows an equipment (sampler) which compresses the stereo signal comprising the signal s1 of L channel and the signal s2 of R channel, converts it to the PCM data and stores the data in the memory.

The low pass filters 120 and 121 are filters for removing the high-frequency component of signals s1 and s2, respectively. The signal s1 processed through the filter is led to the input terminal (+ terminal) of the sample-hold circuit 122 and to the subtracting circuit 123. The signal s2 which passes through the filter 121 is led to another input terminal (− terminal) of the subtracting circuit 123. The signal s1 is sample-held in the sample hold circuit 122 and outputted to the 8-bit AD converter 124. The sampling frequency of the AD converter 124 is f1 (44 kHz). The subtracting circuit 123 takes out the differential signal (s −s2) of signals s1 and s2 and outputs it to the sample-hold circuit 125. The signal sample-held by this sample-hold circuit 125 is outputted to the 8-bit AD converter 126. The sampling frequency of this AD converter 126 is f2 (22 kHz). As explained, referring to FIG. 12, the stereo signals s1 and s2 have a close correlation between them and the stereo feeling resulting from the difference in high range is weak, reproduction does not cause remarkable problems even when the frequency band of the differential signal (s1−s2) is wholly reduced as compared to the frequency band of individual signals s1 and s2.

The AD converters 124 and 126 have the AD converter for sampling the analog data and quantizing and the coding circuit for converting quantized PCM data by coding it. The data coded with the AD converters 124 and 126 are led to the memory system. The memory system comprises a memory 127 for storing the 8-bit s1 data converted by the AD converter 24 and a memory 128 for storing the 8-bit (s1−s2) data converted by the AD converter 126.

Figure 16:
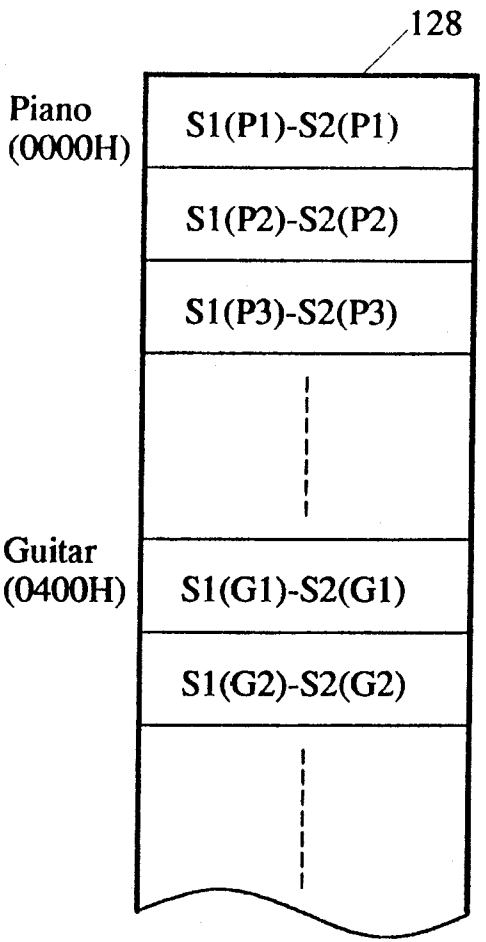
FIG. 16 (A) and FIG. 16 (B) show how data is stored in the memory.
Figure 16:
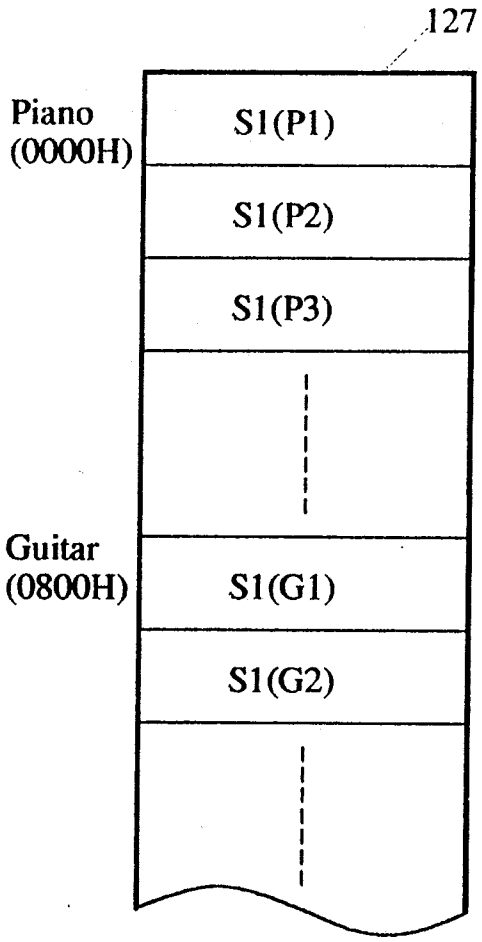

The address generating circuit 129 gives the common address information to the memories 127 and 128. Addressing is classified by tone color. The whole 16-bit address information is given to the memory 127 whereas the high-order 15-bits are given to the memory 128 as address information. Since the high-order 15 bits except for LSB is used as address information for the memory 128, one data (musical tone data) is stored in the memory 128 whenever two data (musical tone data) are stored in the memory 127. FIG. 16 (A) and FIG. 16 (B) show the state of data storage in the memories 127 and 128. In FIG. 16 (A), the data (musical tone data) of piano tone color is stored at the address 0000H to 07FFH. The data (musical tone data) of guitar tone color is stored at 0800H and below. In the memory 128 the data (musical tone data) of piano tone color is stored in the memory at the address 0000H to 03FFH, and the data (musical tone data) of guitar tone color is stored at the address of 0400H and below. As shown in the figure, in the case of musical tone data of piano tone color, the quantity of musical tone data of piano tone color which is stored in the memory 128 is equal to ½ of musical tone data stored in the memory 127. Accordingly, the musical tone data storage area of memory 128 is ½ of musical tone data storage area of musical tone data of memory 127.

Next, the electronic musical instrument having a keyboard shown in FIG. 15 is explained. The configuration of this electronic musical instrument is similar to that shown in FIG. 3.

The key information generating circuit 140 comprises a keyboard 140*a*, a key pressing detecting circuit 140*b*, and a tone generation assignment circuit 140*c*. The key pressing detecting circuit 140*b* detects the key code of the pressed key of keyboard 140*a*. The tone generation assignment circuit 140*c* is a circuit to assign the key code of the pressed key to a proper empty tone generation channel. In the key information generating circuit 140 the key code KC of pressed key, the tone generation channel to which the key code KC is assigned and the key-ON signal KON which indicates that the pertinent key was pressed are generated, and these signals are sent to the address generating circuit 141. In this example of embodiment the key information is sent to the address generating circuit 141 by time-shared processing so that simultaneous tone generating of several sounds can be performed. FIG. 6 shows the format of the key information which is sent to the address generating circuit 141. As shown in the figure the key-on signal KON and the key code KC assigned to each channel successively from the channel ch1 for every T time are sent. The key-on signal KON and the key code KC assigned to the channel of pertinent time slot are given to each time-shared time slot. Here, the key-on signal KON is data "1" or "0". The data "1" indicates that the key having the key code KC given to the same time slot is in pressed state.

The tone color selection signal TC is also inputted to the address generating circuit 141 from the tone color selection circuit 152. The tone color selection circuit 152 is designated to select tone color of piano and guitar, etc. It includes the sound selection switch not shown in the figure. The tone color selection signal TC is used to specify the musical tone data storage area for each tone color stored in the memories 127 and 128 or the start address of this area. When the tone color selection signal TC is received, the address generating circuit 141 specifies the addressing range in the musical tone data storage area for pertinent tone color in the memories 127 and 128. For example, when the tone color selection signal TC selects piano, the range of 0000H to 07FFH of memory 27 is specified, and the range of 0000H to 03FFH of memory 28 is specified.

The address generating circuit 141 generates continuously the address where the musical tone data corresponding to the key code KC inputted as key information in the musical tone data storage area of memories 127 and 128 according to the tone color selection signal TC. This continuous address information changes according to the phase data which decides the frequency of musical tone signal waveform. Since the technology for giving the phase data to the memory storing the musical tone data as address information is well known, its explanation is omitted here.

The musical tone data stored in the above-mentioned memories can be composed as musical tone data of several periods as shown in FIG. 7.

The address data is outputted from the address generating circuit 141 as phase data. As with the above-mentioned key pressing information sending procedure this address data is also sent out by the time-shared processing. Accordingly, the data outputted from the address generating circuit 141 has the format shown in FIG. 8. In this case the time-shared time slot length is set so that the address change speed for each channel is equal to the above-mentioned frequency f1. And as stated latter, the 16-bit address information is given to the memory 127, whereas the high-order 15-bit address information is given to the memory 128. Accordingly, the data read speed of memory 127 is f1, but the data speed of memory 128 is f1/2.

Figure 17:
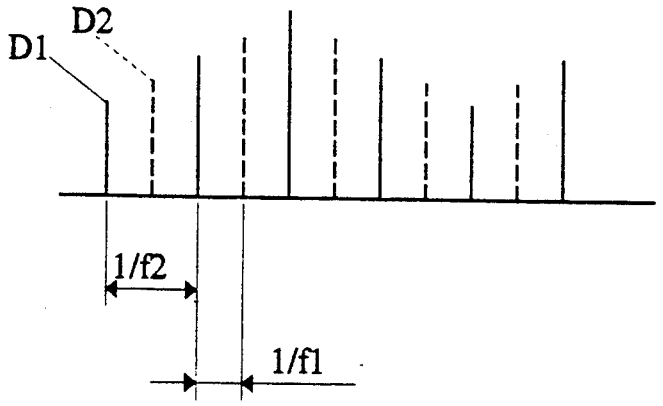
FIG. 17 explains the operation of the double-oversampling digital filter.

The 8-bit musical tone data is stored in the memories 127 and 128 as shown in FIG. 16 (A) and FIG. 16 (B). The musical tone data (s1−s2) of memory 128 is outputted to the double oversampling digital filter 142. This double oversampling digital filter 142 supplements data D2 between data D1 which are shown by the solid line and are outputted from the memory 128 as shown in FIG. 17 and outputs the new data D2 in addition to the initial data. Since data is passed through this double oversampling digital filter 142, the period of musical tone data outputted from this filter is 1/f1 although the data read speed of memory 128 is f1/2. Accordingly, this period is equal to the period of musical tone data outputted from the memory 127.

Figure 18:
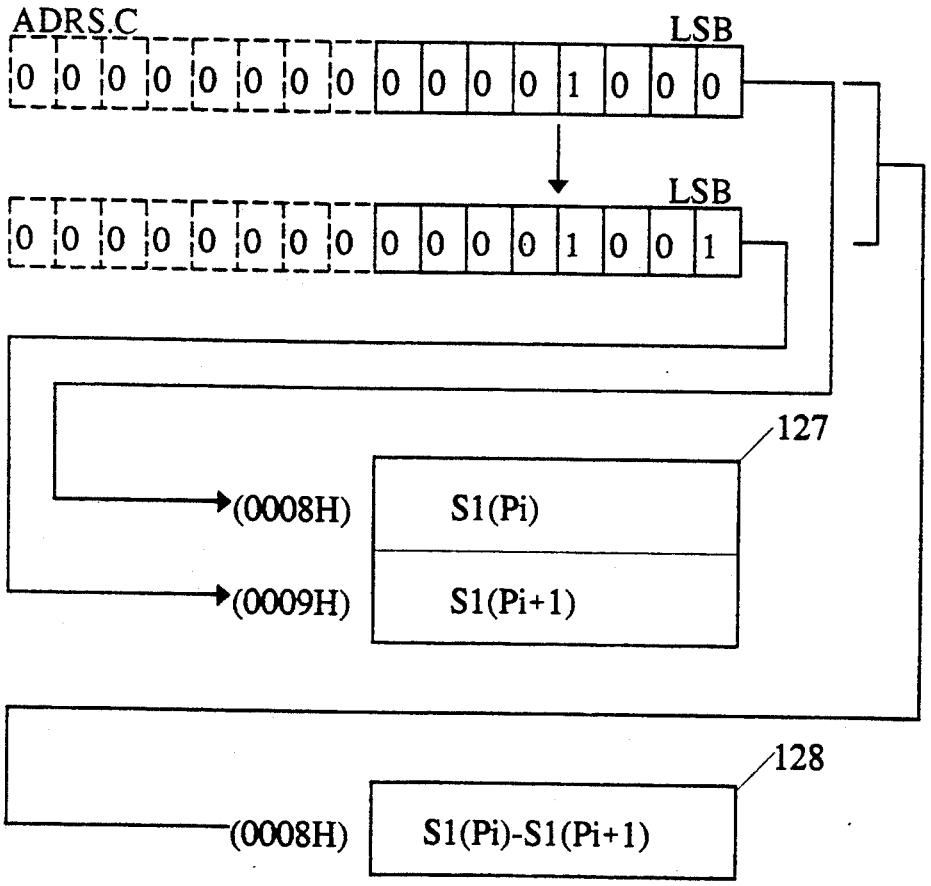
FIG. 18 explains the memory addressing.

FIG. 18 explains addressing of memories 127 and 128. The 16-bit address data is outputted from the address generating circuit 141. These 16bits are all given to the memory 127 as address information. Only the high-order 15 bits are given to the memory 128 as address information. Let us assume here that the content of address counter ADRS. C of address generating circuit 141 advances from 0008H to 0009H as shown in FIG. 18 (at this time the address is generated successively at frequency f1). At this time the s1 (Pi) data and s1 (Pi+1) data are successively outputted from the memory 127. Since only the high-order 15-bit address data is given to the memory 128 as address information, the address specified to the memory 128 remains at 0008H even when the address advances from 0008H to 0009H. Accordingly, whenever the two musical tone data are outputted from the memory 127, one musical tone data is outputted from the memory 128.

Since the period of the musical tone data outputted from the memory 128, the output from the double oversampling digital filter 142 and the musical tone data outputted from the memory 127 have the period of 1/f1.

The output of double oversampling digital filter 142 and output of memory 127 are led to the subtracting circuit 43 where subtraction S1−(S1−S2) is performed. As a result of this subtraction the data s1−(s1−s2)=s2 appears as output of subtracting circuit.

The s1 data outputted from the memory 127 and the s2 data outputted from the subtracting circuit 143 are led to the envelop generator 144 and 145, respectively, where they are subject to amplitude modulation. The tone color selection signal TC outputted from the tone color selection circuit 152 and the key-on signal KON outputted from the key information generation circuit 140 are led to the envelop generator (EG), the input data is amplitude-modulated based on the tone color selection signal TC, and the amplitude-modulated signal is outputted synchronizing with the key-on signal KON. The signals amplitude-modulated by EG144 and 145 are accumulated in the accumulators 146 and 147, respectively. In these accumulators 146 and 147 the time-shared data are accumulated for N channels, namely for each T time. Accordingly, at the stage when the data passes through the accumulators 146 and 147 this data becomes data having period of (1/T). The data which passed through the accumulators 146 and 147 is outputted to the DA converters 148 and 149. Here, it is converted to the analog signal, outputted to the sound systems 150 and 151, and then it is outputted as sound. In this example of embodiment the stereo signal comprising the L channel signal s1 and the R channel signal s2 can be compressed by using the above-mentioned configuration. As a result of this signal compression the capacity of memory system can be reduced to $\frac{3}{4}$ of capacity of memory system which is designated to store individually data for each channel.

ANOTHER EXAMPLE OF EMBODIMENT (1)

In the example of embodiment mentioned above the differential signal (s1−s2) is sampled with f2(f2<f1). Therefore the band of signal s2 component (component of R channel) is restricted by f2. Accordingly, in reproduction mode the sound quality of R channel may be degraded insignificantly as compared to the sound of L channel. This degradation can be prevented by storing the sum signal (s1+ s2) in the memory 127.

Figure 19:
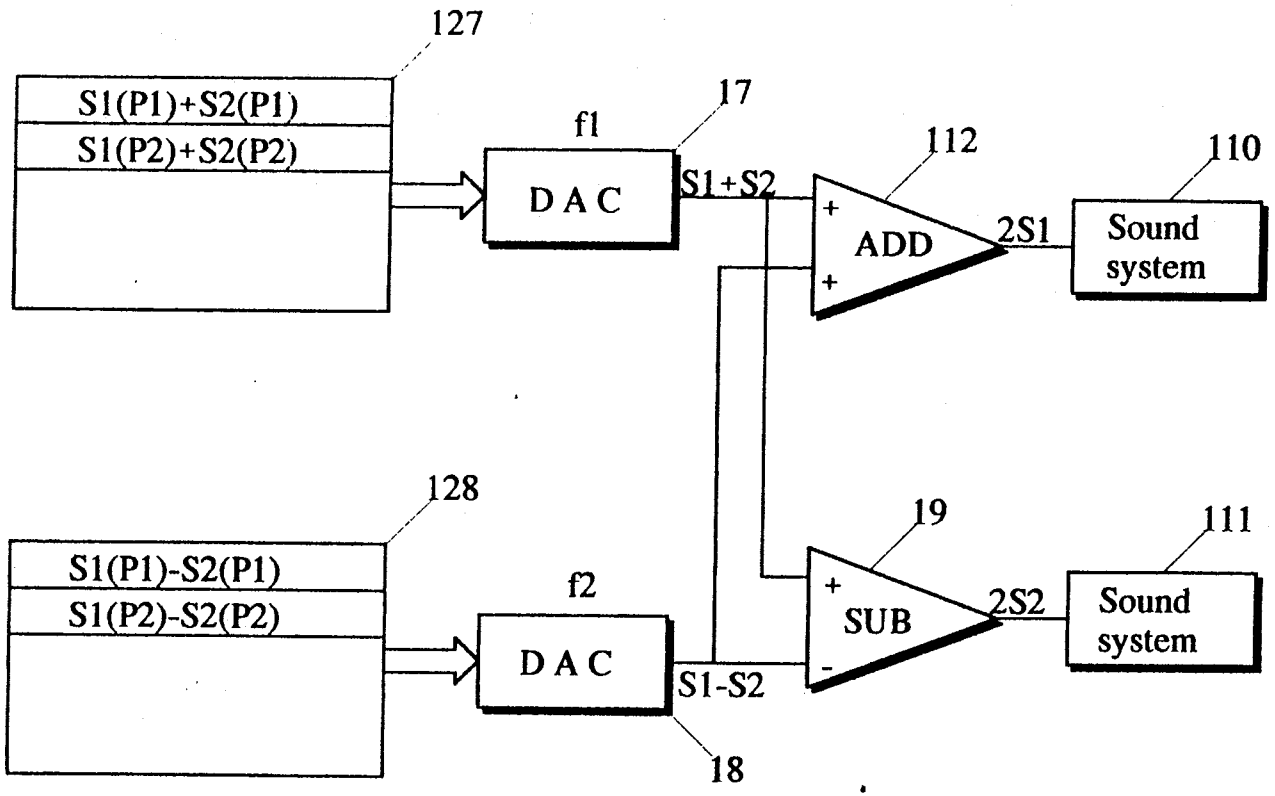
FIG. 19 shows another examples of embodiment of the 2nd method of the invention.

FIG. 19 shows the configuration of memory data read section which is used in the case when the sum signal of signal s1 of L channel and the signal s2 of R channel is stored in the memory 127 and the differential signal thereof is stored in the memory 128. In this example the difference from the configuration shown in FIG. 12 (B) is that the adding circuit 112 designated to add the (s1+s2) data to the (s1−s2) data is provided. At the stage when the data is outputted to the sound systems 110 and 111 the s1 signal component is completely separated from the s2 signal component. In this case the signal s2 which appears as output of the subtracting circuit 19 contains the s2 component sampled at f1. Therefore the frequency band of signal s2 of R channel is not restricted. Even in this case the capacity of memory 128 can be reduced by the same reason as that described in the above-mentioned example of embodiment.

ANOTHER EXAMPLE OF EMBODIMENT (2)

In the examples mentioned above the signal s1 of either of L and R channels and the differential signal (s1−s2) of two signals of L and R channels is sampled at sampling frequencies f1 and f2 (f1>f2). In addition to it the number of quantization bits of differential signal (s1−s2) can be reduced as compared to the number of quantization bits of s1. Since there is extremely strong correlation between the signal s1 of L channel and the signal s2 of R channel, the amplitude information of this differential signal is by far less than the amplitude information of s1 or s2. Consequently, even when the number of quantization bits of differential signal is reduced, adverse effect such as lowering of dynamic range in reproduction mode does not occur. By reducing the number of quantization bits of differential signal the memory capacity can be further reduced.

Figure 20:
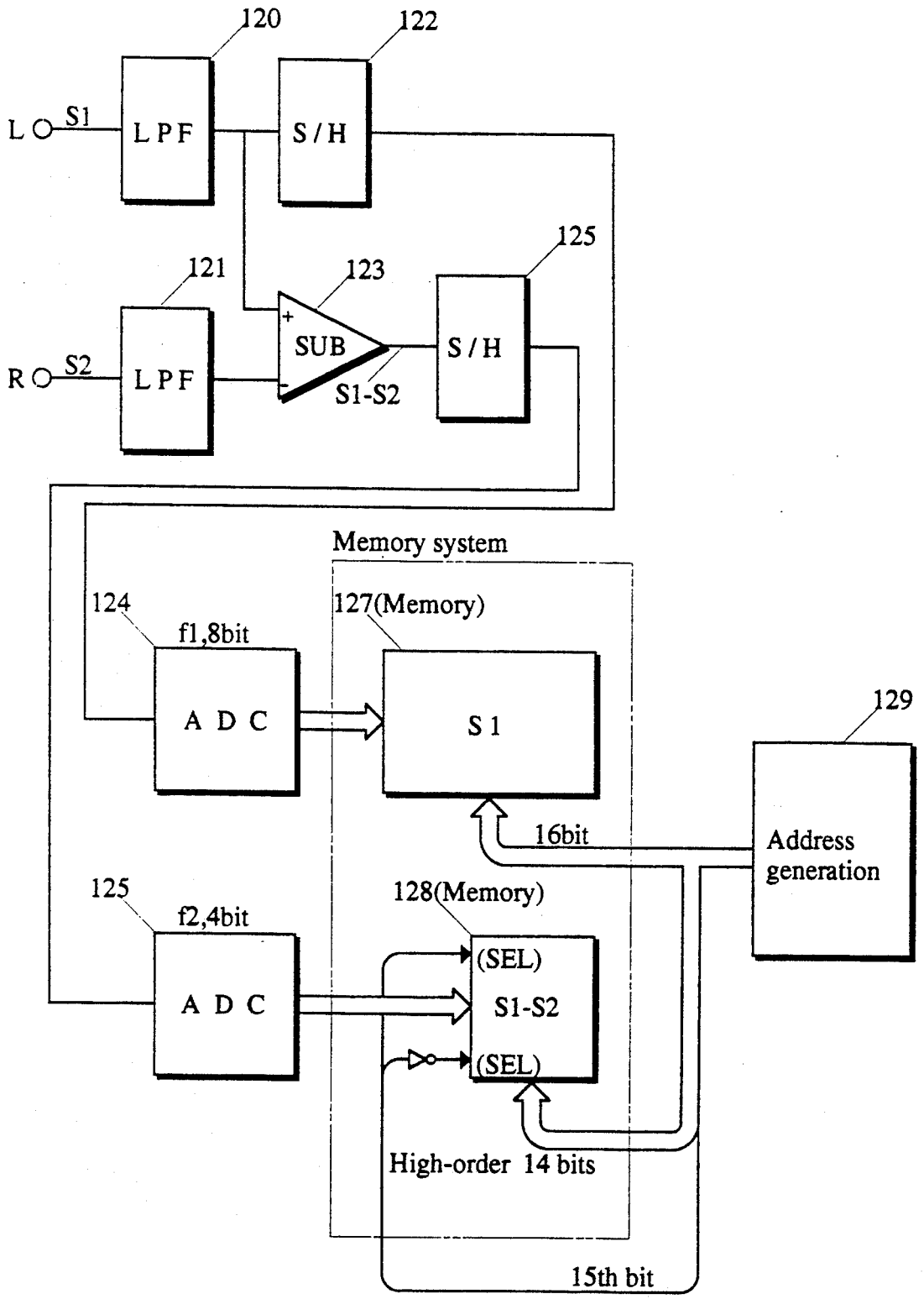
FIG. 20 to FIG. 25(*b*) show other examples of embodiment of the third method of the invention.
Figure 21:
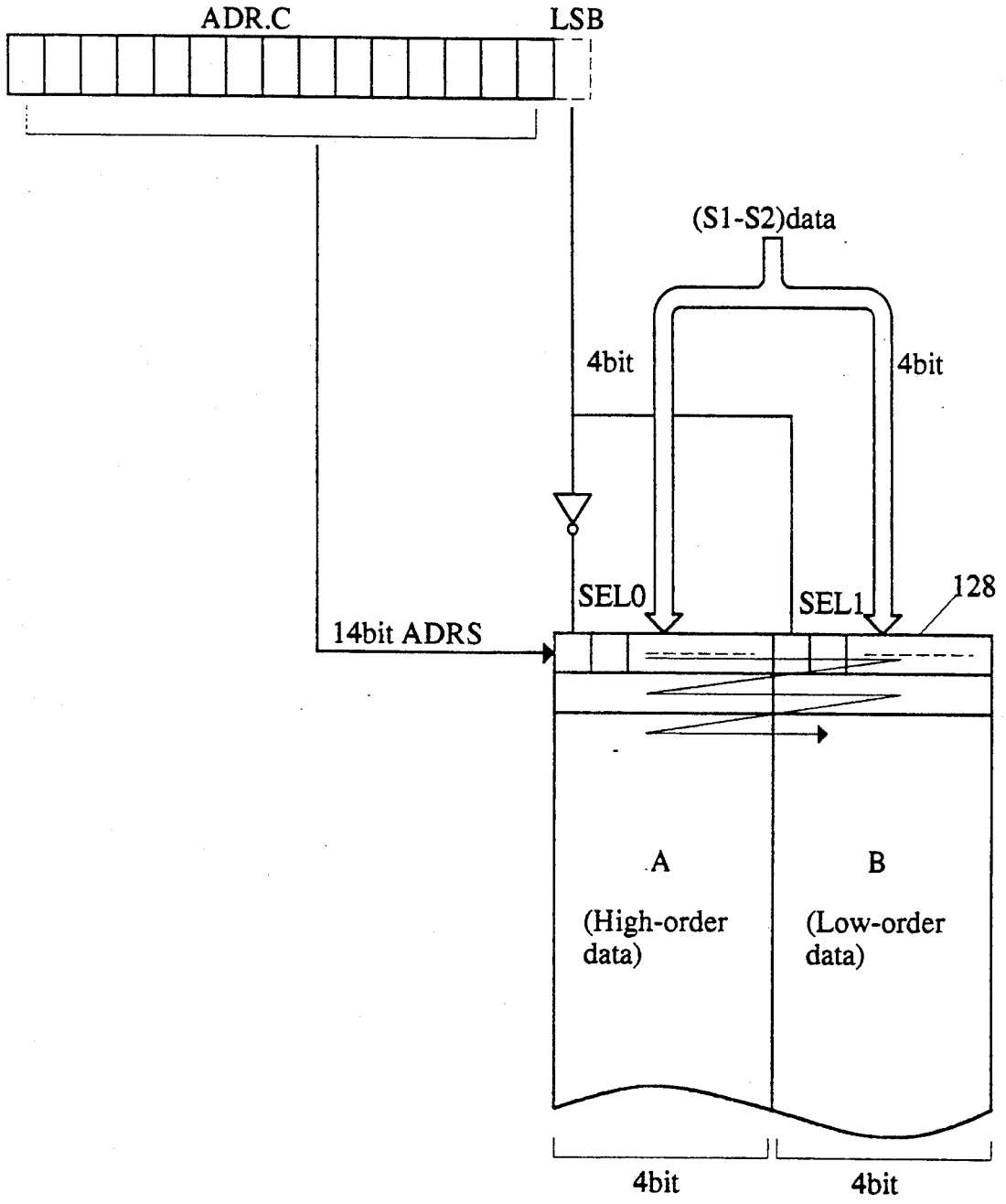

FIG. 20 to FIG. 24 show the examples of embodiment where the sampling frequency of differential signal (s1−s2) is reduced and the number of quantization bits is reduced. FIG. 20 shows the configuration of a sampler. The configurational difference of this sampler from the sampler shown in FIG. 14 is that a 4-bit AD converter having sampling frequency f2 is used as an AD converter 126, and LSB is given from the address generating circuit 129 to the memory 128 as chip select signal. FIG. 21 shows how the (s1 −s2) data is written in the memory 128. The memory 128 has a configuration where the 4-bit memory blocks A and B are parallel connected, and each block A and B is provided with the chip select terminal SEL0 and SEL1. The information of the 15th bit of the address counter ADR.C in the address generating circuit 129 is given directly to the chip select terminal SEL.1 and also to the chip select terminal SEL0 through the inverter. The 4-bit (s1−s2) data is inputted commonly to the memory blocks A and B. Owing to such a configuration, when the 15th bit is "0", the 4-bit (s1−s2) data is stored in the memory A block as high-order data, but when the 15th bit is "1", the 4-bit (s1−s2) data is stored in the memory block B as low-order data. Accordingly, when the count of address counter is incremented, the (s1−s2) data is successively stored in the direction indicated by the arrow mark in the figure.

Since the sampling frequency of the AD converter 126 is f2 (22 kHz), one data is outputted from the AD converter 126 whenever two data are outputted from the AD converter 124 whose sampling frequency is f1 (44 kHz). Consequently, whenever four 8-bit s1 data are stored in the memory 127, one 4-bit (s1−s2) data is stored in the memory 128.

Figure 22:
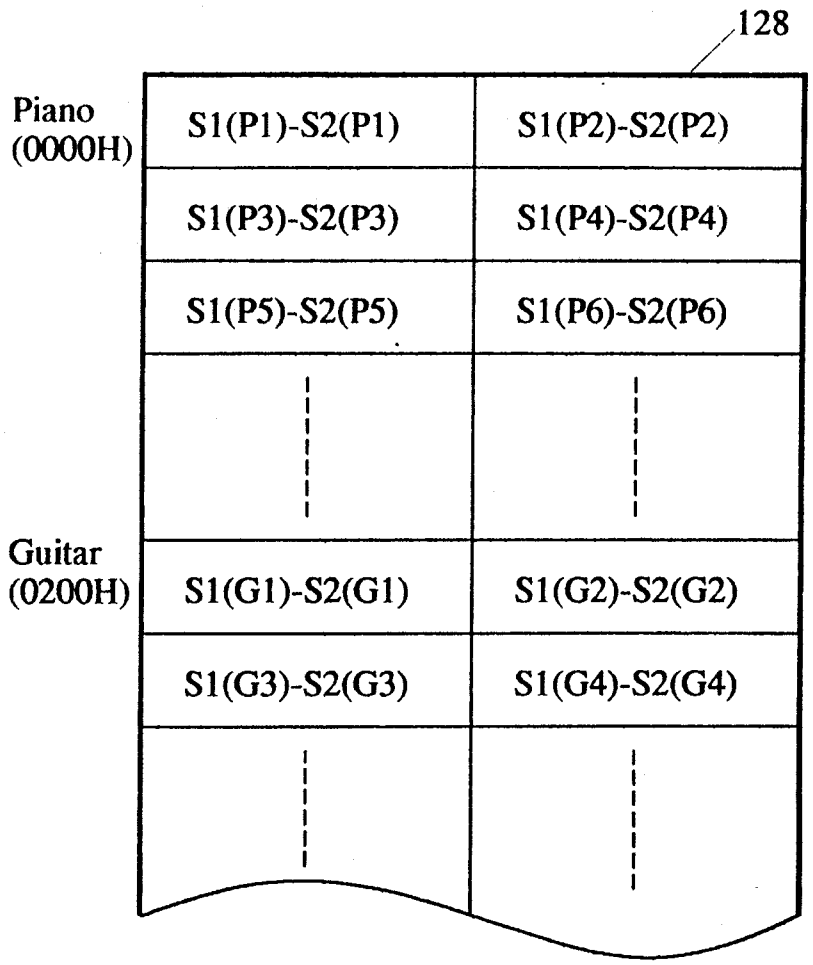
Figure 22:
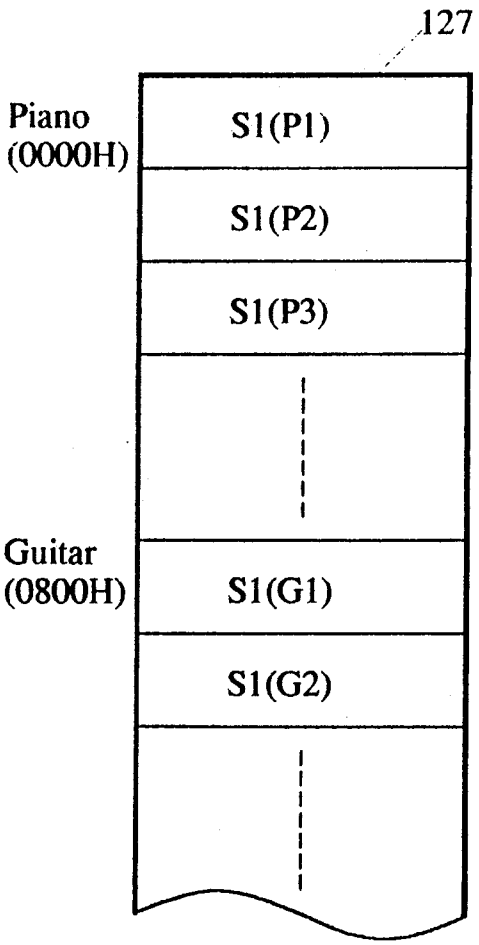

FIG. 22 (A) and FIG. 22 (B) show the data storage state of memories 127 and 128. In this example, the data (musical tone data) of piano tone color is stored at the address 0000H to 07FFH in the memory 127 whereas the data (musical tone data) of guitar tone color is stored at the address 0800H and below. In the memory 128, the data (musical tone data) of piano tone color is stored at the address 0000H to 01FFH whereas the data (musical tone data) of guitar tone color is stored at the address 0200H and below.

Figure 23:
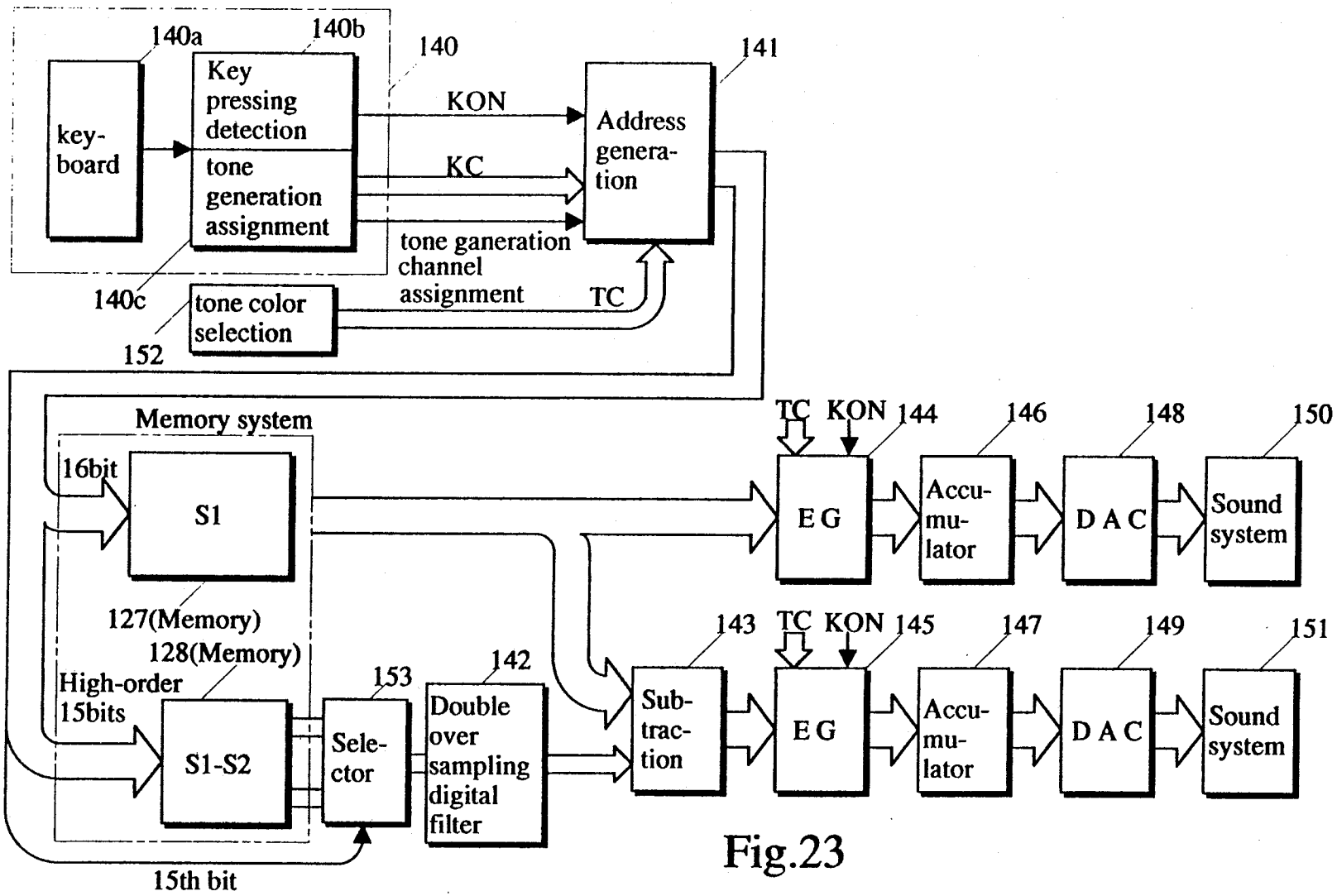

FIG. 23 shows the configuration of an electronic musical instrument having a keyboard. The difference of this configuration from the configuration shown in FIG. 15 is that a selector circuit 153 is provided at the front stage of double oversampling digital filter 142, the high-order 14 bits of address data generated in the address generating circuit 141 is given to the memory 128 as an address information, and the 15th bit is sent to the selector circuit 153 as a selector signal. The selector circuit 153 selects either high-order data or low-order data stored in the memory 128 according to the 15th bit data and outputs it to the double oversampling digital filter 142 of rear stage.

Figure 24:
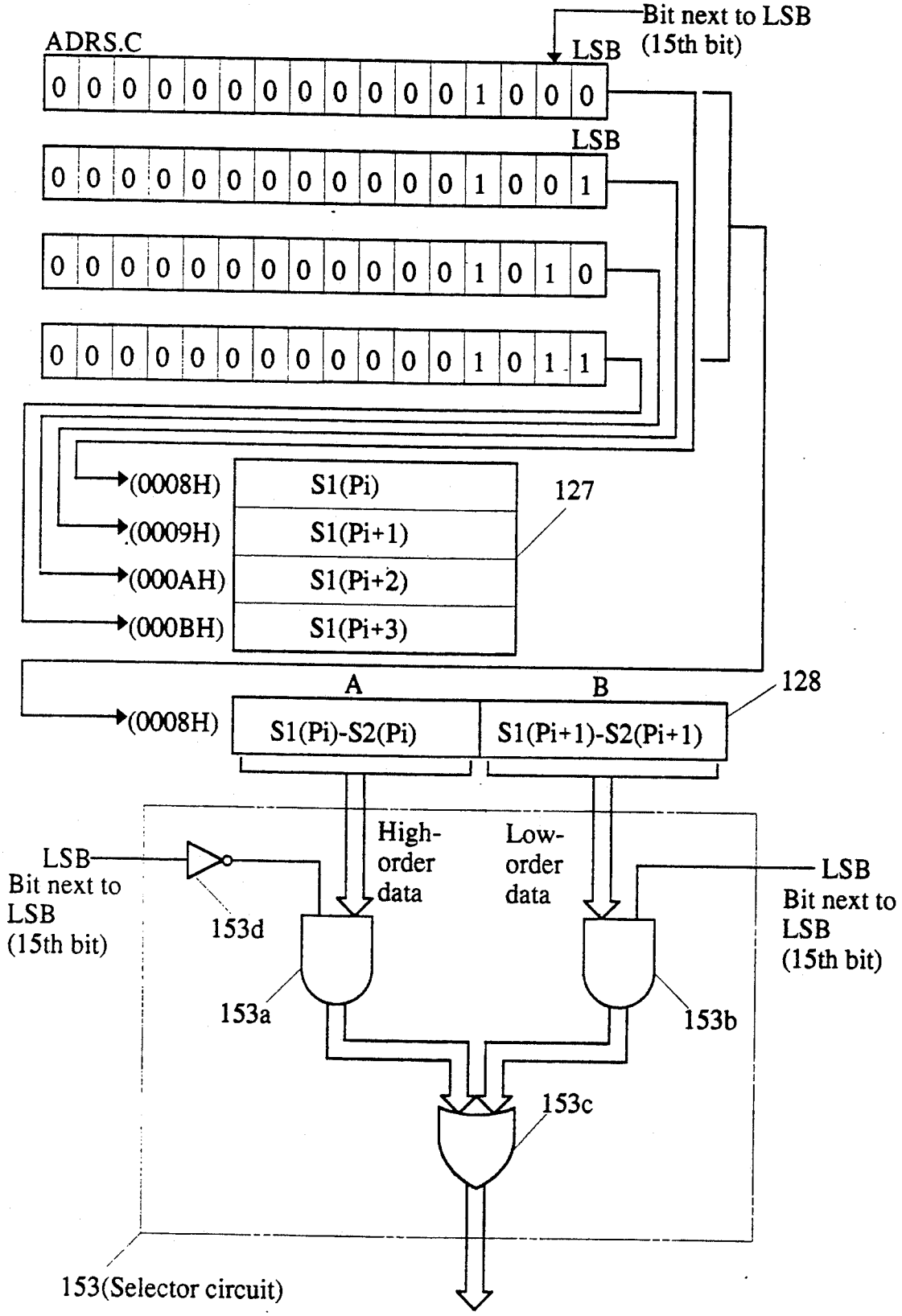
Figure 25B:
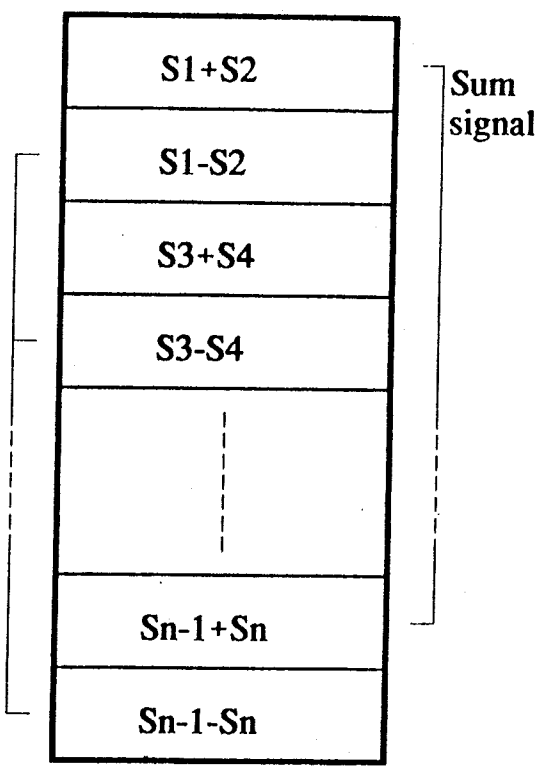
Figure 25A:
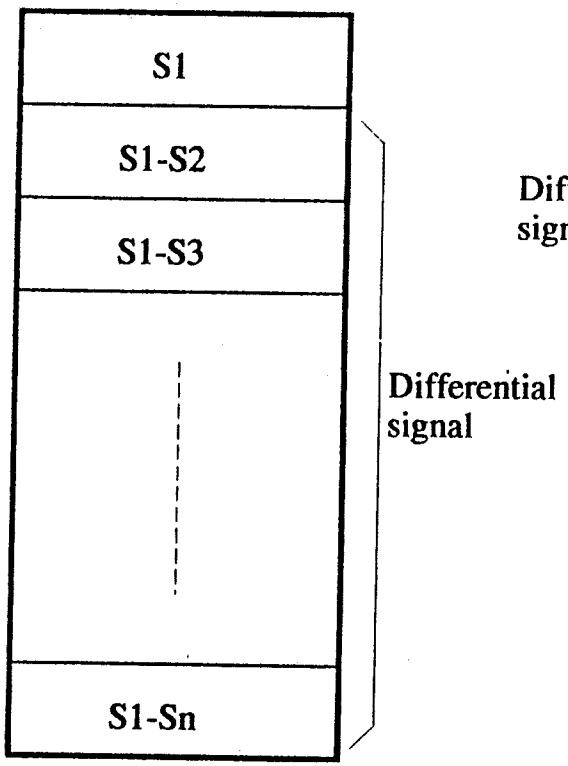

FIG. 24 shows the configuration of the selector circuit 152 and the addressing of the memories 127 and 128. The selector circuit 153 as shown in the figure comprises two AND circuits 153*a* and 153*b*, an OR circuit 153*c* and an inverter 153*d*. The high-order data of A block and low-order data of B block of memory 128 are inputted to the AND circuits 153*a* and 153*b*, respectively. The 15th bit of the 16-bit long address data outputted from the address generating circuit 141 is directly inputted to the AND circuit 153*b* and also inputted to the AND circuit 153*a* through the inverter 153*d*. The output of AND 153*a* and 153*b* is ORed in the OR circuit 153*c* and then outputted to the rear stage.

Let us assume that the content of address counter ADRS.C of the address generating circuit 141 advances 0008H →0009H→000AH→000BH. At this time s1(Pi) data→s1(Pi+1) data→s1(Pi+2) data→s1 (Pi+3) data are outputted successively from the memory 127. These data are all 8-bit data. The read frequency (speed) is f1. Since only the above-mentioned 14-bit address data is given to the memory 128 as address information, the address specified to the memory 128 remains to be 0008H even when the address advances from 0008H to 000BH as stated above. When the address of address counter is 0008H and 0009H, the next bit to LSB is "0". When the address is 000AH and 000BH, the 15th bit is "1". Therefore, in the selector circuit 152, in the former case, the AND circuit 153*a* opens but in the latter case the AND circuit 153*b* opens. Consequently, when the address of address counter is 0008H or 0009H, the high-order data of A block of memory 128 appears in the output of OR circuit 153*c* whereas when the address of address counter is 000AH or 000BH the low-order data of B block of memory 128 appears. Therefore, while the s1(Pi) data and s1(Pi+1) data are outputted from the memory 127, the high-order data [(s1Pi)−s2(Pi)], namely data of A block of memory 128, is outputted from the selector circuit 153. While the s1(Pi+2) data and s1(Pi +3) data are outputted from the memory 127, the [s1(Pi+1) −s2(Pi+1)], namely the low-order data of B block of memory 128, is outputted.

The output of selector circuit 153 is sent to the double oversampling digital filter 142 where supplement of data D2 is performed as shown in FIG. 9.

The output of double oversampling digital filter 142 and the output of memory 127 are led to the subtracting circuit 143 where subtraction s1−(s1−s2) is performed. As a result of this subtraction the data s1−(s1−s2)=s2 appears in the output of subtracting circuit.

Thereafter, similarly to the above-mentioned examples of embodiment, the s1 data outputted from the memory 127 and the s2 data outputted from the subtracting circuit 143 are led to EG144 and EG145, respectively, where the signals are subjected to amplitude modulation, and then they are sent to the accumulators 146 and 147. After that the signals are converted to the analog signals by the DA converters 148 and 149. The obtained signals are outputted as sound by the sound systems 150 and 151.

In this example of embodiment, owing to the above-mentioned configuration the stereo signal comprising the L channel signal s1 and the R channel signal s2 can be compressed (1) by lowering, the sampling frequency of the differential signal (s1−s2) and (2) by reducing the number of quantization bits of differential signal (s1−s2). Moreover, owing to this signal compression the capacity of memory system can be reduced to $\frac{5}{8}$ of memory capacity for individual storage of signals for each channel.

The data compression method of this invention can be combined with the known data compression technology such as PARCOR.

In the example of embodiment the data read speed for waveform data prepared for each tone color is changed according to the key code. It is possible to store the waveform data in the memory system for each key and key range.

what is claimed is:

1. A method for storing and reproducing musical tone signals for plural channels in compressed fashion, comprising the steps of:

providing the musical tone signals of plural channels;

determining with a first subtracting means a differential signal between musical tone signals of at least two of the plural channels, namely channel A and channel B;

quantizing by binary-coding a musical tone signal of either said channel A or B and said differential signal with n bits and m bits (n>m), respectively;

storing individually the quantizied musical tone and differential signals into a memory storage device, reading the stored musical tone and differential signals from the memory storage device, reproducing musical tone signals corresponding to the musical tone signals of the plural channels based on the signals read from the memory storage device, and providing the reproduced musical tone signals to a tone generator for generating musical tones in response to the musical tone signals.

2. A method according to claim 1, wherein the reproducing step comprises:

decoding the stored musical tone and differential signals read from the memory storage device with n bits and m bits, respectively; and subtracting with a second subtracting means the decoded differential signal from the decoded musical tone signal from one of said channels A or B so as to reproduce a musical tone signal corresponding to the musical tone signal of the other of said channels A or B.

3. A method for storing and reproducing musical tone signals for plural channels in compressed fashion, comprising the steps of:

providing the musical tone signals of plural channels;

determining with a first subtracting means a differential signal between musical tone signals of at least two of the plural channels, namely channel A and channel B;

quantizing by binary-coding the sum signal of the musical tone signals of said channels A and B and said differential signal with n bits and m bits (n>m), respectively;

storing individually the quantized musical tone and differential signals into a memory storage device, reading the stored musical tone and differential signals from the memory storage device, reproducing musical tone signals corresponding to the musical tone signals of the plural channels based on the signals read from the memory storage device, and providing the reproduced musical tone signals to a tone generator for generating musical tones in response to the musical tone signals.

4. The method as defined in claim 1 or claim 3 wherein the musical tone signals of said plural channels are stereo signals comprising an L channel signal and an R channel signal.

5. The method as defined in claim 1 or claim 3 wherein said differential signal is determined before said converting.

6. The method as defined in claim 1 or claim 3 wherein said differential signal is determined after said converting.

7. A compressed musical tone signal storing and reproducing device for plural channels, comprising:

means for quantizing by binary-coding either of the musical tone signals of at least two of the plural channels, namely channel A and channel B, with n bits;

means for quantizing by binary-coding a differential signal between the musical tone signals of said two channels A and B with m bits (n>m);

a memory storage device for storing individually the quantized musical tone and differential signals, means for reading the stored musical tone and differential signals from the memory storage device, means for reproducing musical tone signals corresponding to the musical tone signals of the plural channels based on the signals read from the memory storage device, and tone generating means for generating musical tones in response to the musical tone signals.

8. A device according to claim 7, wherein the means for reproducing comprises:

decoding means for decoding the stored musical tone and differential signals read from the memory storage device with n bits and m bits, respectively; and subtracting means the decoded differential signal from the decoded musical tone signal from one of said channels A or B so as to reproduce a musical tone signal corresponding to the musical tone signal of the other of said channels A or B.

9. A compressed musical tone signal storing and reproducing device, comprising:

means for quantizing by binary-coding a sum signal of musical tone signals of at least two of several channels, namely channel A and channel B, with n bits;

means for quantizing by binary-coding a differential signal between musical tone signals of said two channels A and B with m bits (n>m);

a memory storage device for storing individually the quantized musical tone and differential signals, means for reading the stored musical tone and differential signals from the memory storage device, means for reproducing musical tone signals corresponding to the musical tone signals of the plural channels based on the signals read from the memory storage device, and tone generating means for generating musical tones in response to the musical tone signals.

10. The device as defined in claim 7 or claim 9 wherein the musical tone signals of said plural channels are stereo signals comprising an L channel signal and an R channel signal.

11. The device as defined in claim 7 or claim 9 wherein each signal of said plural channels is a musical tone signal and said memory has a storage area for storing said data for each tone color.

12. A method for storing and reproducing musical tone signals for plural channels in compressed fashion, comprising the steps of:

providing musical tone signals of plural channels;

determining with a first subtracting means a differential signal between musical tone signals of at least two of the plural channels, namely channel A and channel B;

sampling the musical tone signal of either said channel A or B and said differential signal with a sampling frequency f1 and f2 (f1>f2), respectively,;

storing individually the sampled musical tone and differential signals into a memory storage device, reading the stored musical tone and differential signals from the memory storage device, reproducing musical tone signals corresponding to the musical tone signals of the plural channels based on the signals read from the memory storage device, and providing the reproduced musical tone signals to a tone generator for generating musical tones in response to the musical tone signals.

13. A method for storing and reproducing musical tone signals for plural channels in compressed fashion, comprising the steps of:

providing musical tone signals of plural channels;

determining with a first subtracting means a differential signal between musical tone signals of at least two of the plural channels, namely channel A and channel B;

sampling a sum signal of musical tone signals of said channels A and B and said differential signal with a sampling frequency f1 and f2 (f1>f2), respectively;

storing individually the sampled musical tone and differential signals into a memory storage device, reading the stored musical tone and differential signals from the memory storage device, reproducing musical tone signals corresponding to the musical tone signals of the plural channels based on the signals read from the memory storage device, and providing the reproduced musical tone signals to a tone generator for generating musical tones in response to the musical tone signals.

14. The method as defined in claim 12 or claim 13 wherein the musical tone signals of said plural channels are stereo signals comprising an L channel signal and an R channel signal.

15. The method as defined in claim 12 or claim 13 wherein said differential signal is determined before said converting.

16. The method as defined in claim 12 or claim 13 wherein said differential signal is determined after said converting.

17. A compressed musical tone signal storing and reproducing device for plural channels, comprising:

means for quantizing by binary-coding after sampling either of musical tone signals of at least two of several channels, namely channel A and channel B, with a sampling frequency f1;

means for quantizing by binary-coding after sampling a differential signal between musical tone signals of said two channels A and B with a sampling frequency f2 (f1>f2);

a memory storage device for storing individually the quantized musical tone and differential signals, means for reading the stored musical tone and differential signals from the memory storage device, means for reproducing musical tone signals corresponding to the musical tone signals of the plural channels based on the signals read from the memory storage device, and a tone generator for generating musical tones in response to the reproduced musical tone signals.

18. A compressed musical tone signal storing and reproducing device, comprising means for quantizing by binary-coding after sampling a sum signal of musical tone signals of at least two of plural channels, namely channel A and channel B, with a sampling frequency f1;

means for quantizing by binary-coding after sampling a differential signal between musical tone signals of said two channels A and B with a sampling frequency f2 (f1>f2);

a memory storage device for storing individually the quantized musical tone and differential signals, means for reading the stored musical tone and differential signals from the memory storage device, means for reproducing musical tone signals corresponding to the musical tone signals of the plural channels based on the signals read from the memory storage device, and a tone generator for generating musical tones in response to the reproduced musical tone signals.

19. The device as defined in claim 17 or claim 18 wherein the musical tone signals of said plural channels are stereo signals comprising an L channel signal and an R channel signal.

20. The device as defined in claim 17 or claim 18 wherein each signal of said plural channels is a musical tone signal and said memory storage device has a storage area for storing said data for each tone color.

21. A method for storing musical tone signals for plural channels in compressed fashion, comprising the steps of:

providing musical tone signals of plural channels;

determining with a first subtracting means a differential signal between musical tone signals of at least two of the plural channels, namely channel A and channel B;

sampling a musical tone signal of the channel A or the channel B at a sampling frequency f1;

quantizing by binary-coding the sampled musical tone signal with n bits;

sampling the differential signal at a sampling frequency f2 (f1>f2);

quantizing by binary-coding the sampled differential signal with m bits (n>m);

storing individually the quantized, sampled musical tone and differential signals into a memory storage device, reading the stored quantized, sampled musical tone and differential signals from the memory storage device, reproducing musical tone signals corresponding to the musical tone signals of the plural channels based on the signals read from the memory storage device, and providing the reproduced musical tone signals to a tone generator for generating musical tones in response to the musical tone signals.

22. The method as defined in claim 21 wherein the signals of said plural channels are stereo signals comprising an L channel signal and an R channel signal.

23. A compressed musical tone signal storing device for plural channels, comprising:

means for sampling either of musical tone signals of at least two of several channels, namely channel A and channel B, at a sampling frequency f1, and for quantizing by binary-coding the sampled musical tone signal with n bits;

means for sampling a differential signal between musical tone signals of said channel A and channel B at a sampling frequency f2 (f1>f2), and for quantizing by binary-coding the sampled differential signal with m bits (n>m);

memories for storing individually the quantized musical tone and differential signals, means for reading the stored musical tone and differential signals from the memory storage device, means for reproducing musical tone signals corresponding to the musical tone signals of the plural channels based on the signals read from the memory storage device, and a tone generator for generating musical tones in response to the reproduced musical tone signals.

24. A machine-implemented method for transmitting musical tone signals for plural channels in compressed fashion, comprising the steps of:

providing musical tone signals of plural channels;

determining with a first subtracting means a differential signal between musical tone signals of at least two of the plural channels, namely channel A and channel B;

quantizing by binary-coding a musical tone signal of either said channel A or B and said differential signals with n bit and m bits (n>m), respectively; and providing the quantized musical tone and differential signals to a transmitter for transmitting individually the quantized signals to a peripheral device.

25. A machine-implemented method for transmitting musical tone signals for plural channels in compressed fashion, comprising the steps of:

providing musical tone signals of plural channels;

determining with a first subtracting means a differential signal between musical tone signals of at least two of the plural channels, namely channel A and channel B;

quantizing by binary-coding the sum signal of musical tone signals of said channels A and B and said differential signal with n bits and m bits (n>m); and providing the quantized musical tone and differential signals to a transmitter for transmitting individually the quantized signals to a peripheral device.

26. A machine-implemented method for transmitting musical tone signals for plural channels in compressed fashion, comprising the steps of:

providing musical tone signals of plural channels;

determining with a first subtracting means a differential signal between musical tone signals of at least two of the plural channels, namely channel A and channel B;

sampling the musical tone signal of either said channel A or B and said differential signal with the sampling frequency f1 and f2 (f1>f2), respectively; and providing the sampled musical tone and differential signals to a transmitter for transmitting individually the sampled signals to a peripheral device.

27. A machine-implemented method for transmitting musical tone signals for plural channels in compressed fashion, comprising the steps of:

providing musical tone signals of plural channels;

determining with a first subtracting means a differential signal between musical tone signals of at least two of the plural channels, namely channel A and channel B;

sampling a sum signal of musical tone signals of said channels A and B and said differential signal with the sampling frequency f1 and f2 (f1>f2), respectively; and providing the sampled musical tone and differential signals to a transmitter for transmitting individually the sampled signals to a peripheral device.

28. A machine-implemented method for transmitting musical tone signals for plural channels in compressed fashion, comprising the steps of:

providing musical tone signals of plural channels;

determining with a first subtracting means a differential signal between musical tone signals of at least two of the plural channels, namely channel A and channel B;

sampling a musical tone signal of the channel A or the channel B at a sampling frequency f1;

quantizing by binary-coding the sampled musical tone signal with n bits;

sampling the differential signal at a sampling frequency f2 (f1>f2);

quantizing by binary-coding the sampled differential signal with m bits (n>m); and providing the quantized musical tone and differential signals to a transmitter for transmitting individually the quantized signals to a peripheral device.

* * * * *